US007703872B2

(12) United States Patent
Nishikori et al.

(10) Patent No.: US 7,703,872 B2
(45) Date of Patent: Apr. 27, 2010

(54) INK JET PRINTING APPARATUS AND INK JET PRINTING METHOD

(75) Inventors: Hitoshi Nishikori, Tokyo (JP); Hideaki Takamiya, Kawasaki (JP); Hiroshi Tajika, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 504 days.

(21) Appl. No.: 11/693,411

(22) Filed: Mar. 29, 2007

(65) Prior Publication Data

US 2007/0236523 A1 Oct. 11, 2007

(30) Foreign Application Priority Data

Apr. 10, 2006 (JP) ..... 2006-108069

(51) Int. Cl.
*B41J 29/38* (2006.01)

(52) U.S. Cl. ..... 347/14; 347/11; 347/17; 347/19

(58) Field of Classification Search ..... 347/12, 347/14, 15, 17, 19, 43, 57
See application file for complete search history.

(56) References Cited

U.S. PATENT DOCUMENTS

| | | | | |
|---|---|---|---|---|
| 5,166,699 | A | 11/1992 | Yano et al. | 346/1.1 |
| 5,805,312 | A * | 9/1998 | Ozawa et al. | 358/503 |
| 5,861,895 | A | 1/1999 | Tajika et al. | |
| 5,894,314 | A | 4/1999 | Tajika et al. | |
| 6,116,710 | A | 9/2000 | Tajika et al. | |
| 6,252,616 | B1 | 6/2001 | Okazaki et al. | 347/65 |
| 6,439,696 | B1 | 8/2002 | Murakami et al. | |
| 6,457,794 | B1 | 10/2002 | Tajika et al. | |
| 6,769,755 | B2 * | 8/2004 | Mizutani et al. | 347/14 |
| 2007/0236522 | A1 | 10/2007 | Takamiya et al. | |
| 2007/0236523 | A1 | 10/2007 | Nishikori et al. | 347/14 |

FOREIGN PATENT DOCUMENTS

| | | |
|---|---|---|
| JP | 5-31905 | 2/1993 |
| JP | 07-052388 | 2/1995 |
| JP | 09-174884 | 7/1997 |
| JP | 11-099638 | 4/1999 |
| JP | 2001-058412 | 3/2001 |
| JP | 2001-180015 | 7/2001 |
| JP | 2004-1435 | 1/2004 |
| JP | 2005-231059 | 9/2005 |

* cited by examiner

*Primary Examiner*—Thinh H Nguyen
(74) *Attorney, Agent, or Firm*—Fitzpatrick, Cella, Harper & Scinto

(57) ABSTRACT

A plurality of print modes having different drive voltage values are provided for each ink temperature and, in each print mode, the ejection volume control is performed by adjusting the drive pulse. In a high quality mode that gives priority to an image quality, a drive pulse of relatively low voltage and long pulse width is applied. In a high speed mode that gives priority to a print speed, a drive pulse of relatively high voltage and short pulse width is applied. In the high quality mode this control allows the ejection volume to be controlled in a wide temperature range, stabilizing the color reproduction. In the high speed mode this control allows the drive frequency of the print head to be raised, increasing the print speed.

14 Claims, 23 Drawing Sheets

INK JET PRINTING APPARATUS AND INK JET PRINTING METHOD

BACKGROUND OF THE INVENTION

1. Field of the Invention

The present invention relates to an ink jet printing apparatus and an ink jet printing method which prints an image on a print medium by ejecting ink onto the print medium and more particularly to a method of controlling voltage pulses applied to electrothermal transducers (heaters) for ejecting ink.

2. Description of the Related Art

The ink jet printing apparatus forms an image by ejecting ink from print elements in response to an image signal to print a plurality of dots on a print medium. Such an ink jet printing system has many advantages over other printing systems, including high speed, high density printing, a color printing capability with a simple construction and a quietness during printing.

A construction that ejects ink from print elements has already been proposed and implemented in some types of printing apparatus, of which a type that uses electrothermal transducers (heaters) in print elements can eject small drops of ink at a high density and at a high frequency and thus has found a wide range of applications. An ink jet print head of this construction has a plurality of print elements arrayed at a density corresponding to a print resolution. Each of the print elements is provided with a liquid path to introduce ink to a nozzle opening and also an electrothermal transducer (heater) in contact with the ink in the liquid path. In ejecting ink from the print elements in response to an image signal, individual heaters are applied a predetermined voltage pulse to be energized to heat the ink. A rapid heating causes the ink in contact with the heater surface to produce a film boiling, in which an expanding bubble expels a predetermined volume of ink from the nozzle opening which flies and lands on a print medium forming a dot.

Further, the ejection volume is influenced by the temperature of the print head or more directly by the temperature of ink near the heater. This is because an ink viscosity changes with an ink temperature and a volume of a bubble and its growth speed during the film boiling depend on the ink viscosity. For example, when the temperature of the print head is low, the ink viscosity increases, making a bubble volume small, with the result that the volume of ink ejected and therefore an area of a printed dot become small. Conversely, when the print head temperature is high, the ink viscosity lowers, making the bubble volume large, with the result that the volume of ink ejected and therefore the printed dot area increase. That is, even if the printing is done based on the same image data, an unstable print head temperature would make the size of dots formed on a print medium unstable, which in turn leads to unstable image density.

Further, when a color image is printed using a plurality of print heads, temperature variations among the different color print heads will likely result in a color produced differing from a desired one. Furthermore, if the temperatures of individual print heads change, the color produced will deviate unstably from target color coordinates.

In the print head manufacturing process, the print heads with a bubble forming heater inevitably have some variations in heater resistance. Considering the print head construction, it is also inevitable that the temperature varies among the print heads depending on the environment in which the printing apparatus is used or the frequencies of use of individual color heads. However, in the ink jet printing apparatus variations in image density and color produced are not desirable. It is therefore one of important tasks with the ink jet printing apparatus to stabilize the ejection volume of the print heads.

Japanese Patent Laid-Open No. 5-031905 (1993) discloses a technology which applies two voltage pulses for each ink ejection and controls a pulse width stepwise according to the temperature of the print head to stabilize the ejection volume of ink. This ejection volume control is referred to as a double pulse drive control. A control circuit of the ink jet printing apparatus sets the pulse width of the pulse signal for ink ejection according to the temperature.

FIG. 19 is a timing chart showing the double pulse drive control. An abscissa represents time and an ordinate represents a voltage applied to the heater. One ejection is done by two pulses shown in the figure. A control circuit in the ink jet printing apparatus sets a pulse width of a pulse signal shown in the figure according to the temperature to stabilize a volume of ejected ink droplets. In the figure, P1 represents a preheat pulse application time, P3 a main heat pulse application time, and P2 an interval between the preheat pulse and the main heat pulse.

The preheat pulse is applied to warm ink near the heater surface and its application time P1 is set so as to keep the energy applied at a level that will not result in generation of a bubble. The main heat pulse on the other hand is applied to cause a film boiling in the ink warmed by the preheat pulse and thereby execute an ejection. Its application time P3 is set larger than P1 so as to produce enough energy to generate a bubble.

As described above, the ink ejection volume is considered as being dependent on a temperature distribution of ink near the heater. Japanese Patent Laid-Open No. 5-031905 (1993) discloses a method which adjusts the pulse width P1 of the preheat pulse according to the detected temperature to realize a stable ejection volume. More specifically, as the detected temperature gradually increases, for example, the necessity of heating the ink near the heater surface decreases progressively. The preheat pulse width P1 is therefore set to decrease progressively. Conversely, when the detected temperature gradually lowers, the necessity of warming the ink near the heater surface progressively increases and the preheat pulse width P1 is set to increase progressively.

The use of this double pulse drive control enables the ejection volume of ink to be kept constant stably for all colors even if the individual print heads have different temperatures at any given time.

In the conventional double pulse drive control such as disclosed in Japanese Patent Laid-Open No. 5-031905 (1993), an energy applied to the heater is adjusted by changing the pulse width while keeping the drive voltage constant. It should be noted, however, that the stabilization of ejection volume can also be achieved with a single pulse by changing the pulse voltage and the pulse width simultaneously. Such ejection volume control methods (hereinafter referred to as single pulse drive controls) are disclosed in Japanese Patent Laid-Open Nos. 2001-180015 and 2004-001435.

In the ink jet printing apparatus with a heater, there is a tendency that the ejection volume is larger when a lower voltage pulse is applied for a longer duration than when a higher voltage pulse is applied for a shorter duration. This is considered due to the fact that the application of a lower voltage pulse for a longer duration causes an ink area that is heated up to a bubble forming temperature to spread more widely by heat conduction, whereas applying a high voltage rapidly heats only an area very close to the heater, causing an instant generation of a bubble, resulting in a smaller ejection volume. Japanese Patent Laid-Open Nos. 2001-180015 and 2004-001435 describe an ejection control method that takes advantage of such an ejection characteristic and which, when one wishes to increase the ejection volume, reduces the drive voltage and widens (elongates) the pulse width and, when one wishes to reduce the ejection volume, raises the drive voltage and narrows (shortens) the pulse width.

As described above, the ink jet printing apparatus of recent years seek to keep the ejection volume as stable as possible by adopting the double pulse drive control method described in Japanese Patent Laid-Open No. 5-031905 and the single pulse drive control method disclosed in Japanese Patent Laid-Open Nos. 2001-180015 and 2004-001435.

The ink temperature in the print head rises as the printing operation continues. So, in the single pulse drive control if one wishes to stabilize the ejection volume in as wide a temperature range as possible, it is preferable to set the drive voltage as low as possible at the start of printing, i.e., at a normal temperature. This is because a lower voltage allows the heat flux to be set lower, reducing the effect a pulse width change has on the ejection volume and thereby making it possible to perform the ejection volume control with precision. It is noted, however, that setting the drive voltage low increases the pulse width required to eject ink, i.e., the time taken by one ejection, resulting in a slower printing speed.

To realize a fast printing, the drive voltage at the lowest temperature at which the print head can print (referred to as a start temperature) needs to be set as high as possible to shorten the time taken by one ejection. This, however, causes the heat flux to be high, rendering the precise control of ejection volume impossible. It also makes the voltage used for the ejection volume control more likely to reach the upper limit of the voltage that the printing apparatus can provide, rendering the ejection volume control itself difficult. Although this problem may be avoided by setting high beforehand the upper limit of the drive voltage that can be supplied to the print head, a circuit that can withstand a higher drive voltage is likely to have an increased circuit area, resulting in an increase in the manufacturing cost. In the ink jet printing apparatus with low cost and small size as one its features, the high voltage drive design is not so practicable.

We have explained the single pulse drive control. The double pulse drive control also has a similar tendency in the relationship between the ejection volume control and the drive voltage. The double pulse drive control keeps the drive voltage at a constant value irrespective of the ink temperature. Depending on whether this constant value is set relatively low or high, the precision of the ejection volume control and the printing speed vary.

The double pulse drive control reduces the preheat pulse width progressively as the temperature rises, to keep the ejection volume within a predetermined range. So, basically the ejection volume control can be performed in a temperature range from the start temperature to a temperature at which the preheat pulse width becomes zero. If the drive voltage is set relatively low, the heat flux from the heater to the ink is small so that a change in the preheat pulse width has little effect on the ejection volume, allowing for a correspondingly more precise ejection volume adjustment. Further, since the preheat pulse width at the start temperature is relatively long, the ejection volume control can be executed in a wide temperature range up to the temperature where the preheat pulse width becomes zero. It should be noted, however, that, as with the single pulse drive control, the longer pulse width results in each ejection taking longer and the printing speed getting slower.

When, on the other hand, the drive voltage is set relatively high, the preheat pulse width at the start temperature can be set short beforehand, allowing for a faster printing speed. However, since the heat flux from the heater to the ink at time of preheat pulse application is high, the effect a change in the preheat pulse width has on the ejection volume increases. This means that the adjustment of the ejection volume becomes that much coarse. Further, since the preheat pulse width at the start temperature is short, even a slight temperature change can result in the preheat pulse width becoming zero, narrowing the temperature range where the ejection volume control can be performed normally.

Recent years have seen the use of the ink jet printing apparatus grow in versatility and there are growing needs for a capability to print a variety of kinds of images on various types of print mediums. One such example is a demand for printing on a sheet of glossy photographic paper a picture image with as stable a color as will match that of a silver salt picture. To meet this demand requires an ejection volume control with high precision and reliability. At the same time, there is also a call for printing monochrome text images on low-cost plain paper at high speed. To meet this demand requires reducing a drive pulse width. Under these circumstances, the conventional ink jet printing apparatus have difficulty meeting the two needs of the users—the image quality and the printing speed—at the same time.

SUMMARY OF THE INVENTION

The present invention has been accomplished to solve the problems described above. It is an object of this invention to provide an ink jet printing apparatus and an ink jet printing method which can satisfy the user in both image quality and printing speed by allowing the user to select from among a plurality of print modes giving a priority to different needs according to uses.

The first aspect of the present invention is an ink jet printing apparatus to form an image on a print medium by using a print head, wherein the print head is composed of an array of a plurality of print elements adapted to eject ink by applying pulse to a heater, the ink jet printing apparatus comprising: selection means for selecting one of a plurality of print modes; acquire means for acquiring an ink temperature in the print head; setting means for setting the pulse to be applied to the heater according to information about the print mode selected by the selection means and about the ink temperature acquired by the acquire means; and driving means for driving the print element by applying the set pulse to the heater; wherein the pulse set by the setting means in at least one print mode selected from among the plurality of print modes differs in voltage value from a pulse that the setting means sets in other print modes.

The second aspect of the present invention is an ink jet printing method to form an image on a print medium by using a print head, wherein the print head is composed of an array of a plurality of print elements adapted to eject ink by applying a pulse to a heater, the ink jet printing method comprising the steps of: selecting one of a plurality of print modes; acquiring an ink temperature in the print head; setting the pulse to be applied to the heater according to information about the print mode selected by the selection step and about the ink temperature; and driving the print element by applying the set pulse to the heater; wherein the pulse set by the setting step when at least one print mode is selected from among the plurality of print modes differs in voltage value from the pulse set when other print modes are selected.

Further features of the present invention will become apparent from the following description of exemplary embodiments (with reference to the attached drawings).

DESCRIPTION OF THE EMBODIMENTS

First Embodiment

1. Basic Construction 1.1 Outline of Printing System

Figure 1:
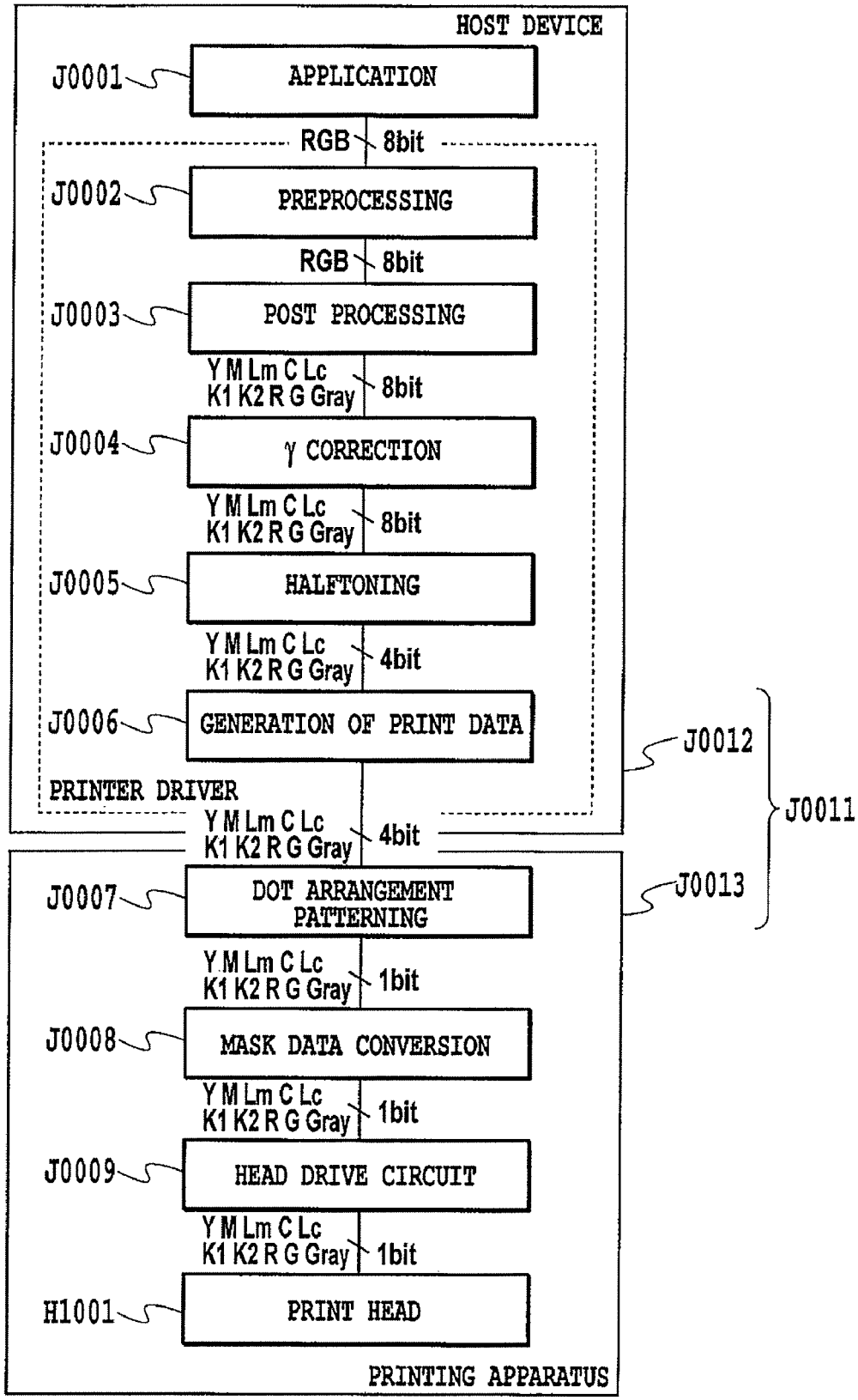
FIG. 1 is a diagram showing a flow of image data processing performed in a print system applied to an embodiment of this invention.

FIG. 1 shows a flow of image data processing in a print system applied to the embodiment of this invention. The print system J0011 has a host device J0012 that generates image data representing an image to be printed and sets a UI (user interface) for data generation. It also has a printing apparatus J0013 that prints on a print medium according to the image data generated by the host device J0012. The printing apparatus J0013 uses 10 color inks—cyan (C), light cyan (Lc), magenta (M), light magenta (Lm), yellow (Y), red (R), green (G), first black (K1), second black (K2) and gray (Gray). Thus it uses a print head H1001 that ejects these 10 color inks.

Among programs that run on an operating system of the host device J0012 are applications and a printer driver. The application J0001 generates image data to be printed by the printing apparatus. On a UI screen of a monitor of the host device J0012, the user makes setting on such items as a kind of print medium to be used for printing and a print quality and issues a print command. In response to this print command, image data R, G, B is handed over to the printer driver.

The printer driver has, as its functions, preprocessing J0002, post processing J0003, γ correction J0004, half toning J0005 and print data generation J0006. These processing J0002-J0006 executed by the printer driver will be briefly explained as follows.

(A) Preprocessing

The preprocessing J0002 performs mapping of a gamut or color space. In this embodiment, it performs data conversion to map the gamut reproduced by image data R, G, B of standard color space, sRGB, into a color space reproduced by the printing apparatus J0013. More specifically, it transforms 8-bit, 256-grayscale image data R, G, B into 8-bit data R, G, B in the color space of the printing apparatus J0013 by using a three-dimensional LUT.

(B) Post Processing

The post processing J0003 determines 8-bit, 10-color component data Y, M, Lm, C, Lc, K1, K2, R, G, Gray corresponding to a combination of inks that reproduces a color represented by the color space-mapped 8-bit data R, G, B. In this embodiment, the post processing also performs an interpolation calculation using the three-dimensional LUT, as in the preprocessing.

(C) γ Correction

The γ correction J0004 performs a density (grayscale value) conversion on the color component data for each color that was calculated by the post processing J0003. More specifically, by using a one-dimensional LUT corresponding to a grayscale characteristic of each color ink of the printing apparatus J0013, the γ correction performs a conversion that linearly matches the color component data to the grayscale characteristic of the printing apparatus.

(D) Half Toning

The half toning J0005 executes a quantization that transforms each of the γ-corrected 8-bit color component data Y, M, Lm, C, Lc, K1, K2, R, G, Gray into 4-bit data. In this embodiment the 256-grayscale 8-bit data is transformed into 9-grayscale 4-bit data by using the error diffusion method. The 4-bit data is an index representing a dot pattern formed by the dot arrangement patterning processing in the printing apparatus.

(E) Print Data Generation

As the last processing executed by the printer driver, the print data generation J0006 adds print control information to the image data represented by the 4-bit index data to generate print data. The print data comprises the print control information used to control the printing operation and the image data representing an image to be printed (4-bit index data). The print control information includes, for example, "print medium information", "print quality information" and "other control information" such as "paper feeding method". The print data generated as described above is supplied to the printing apparatus J0013.

The printing apparatus J0013 performs dot arrangement patterning J0007 and mask data conversion J0008, described below, on the print data supplied from the host device J0012.

(F) Dot Arrangement Patterning

The above half toning J0005 reduces the grayscale level from the 256-multivalued density information (8-bit data) to 9-valued grayscale information (4-bit data). However, the data the printing apparatus J0013 can actually print is binary data (1-bit data) indicating whether or not to print an ink dot. So, to each pixel represented by the 4-bit data of grayscale level 0-8 output from the half toning J0005, the dot arrangement patterning J0007 allots a dot arrangement pattern corresponding to the grayscale level (0-8) of the pixel. That is, each of a plurality of sub-areas making up one pixel is given on/off data—1-bit binary data "1" or "0"—specifying whether or not an ink dot is to be printed in that sub-area. Here "1" specifies that a dot is to be printed in the sub area of interest and "0" specifies that a dot is not to be printed.

Figure 2:
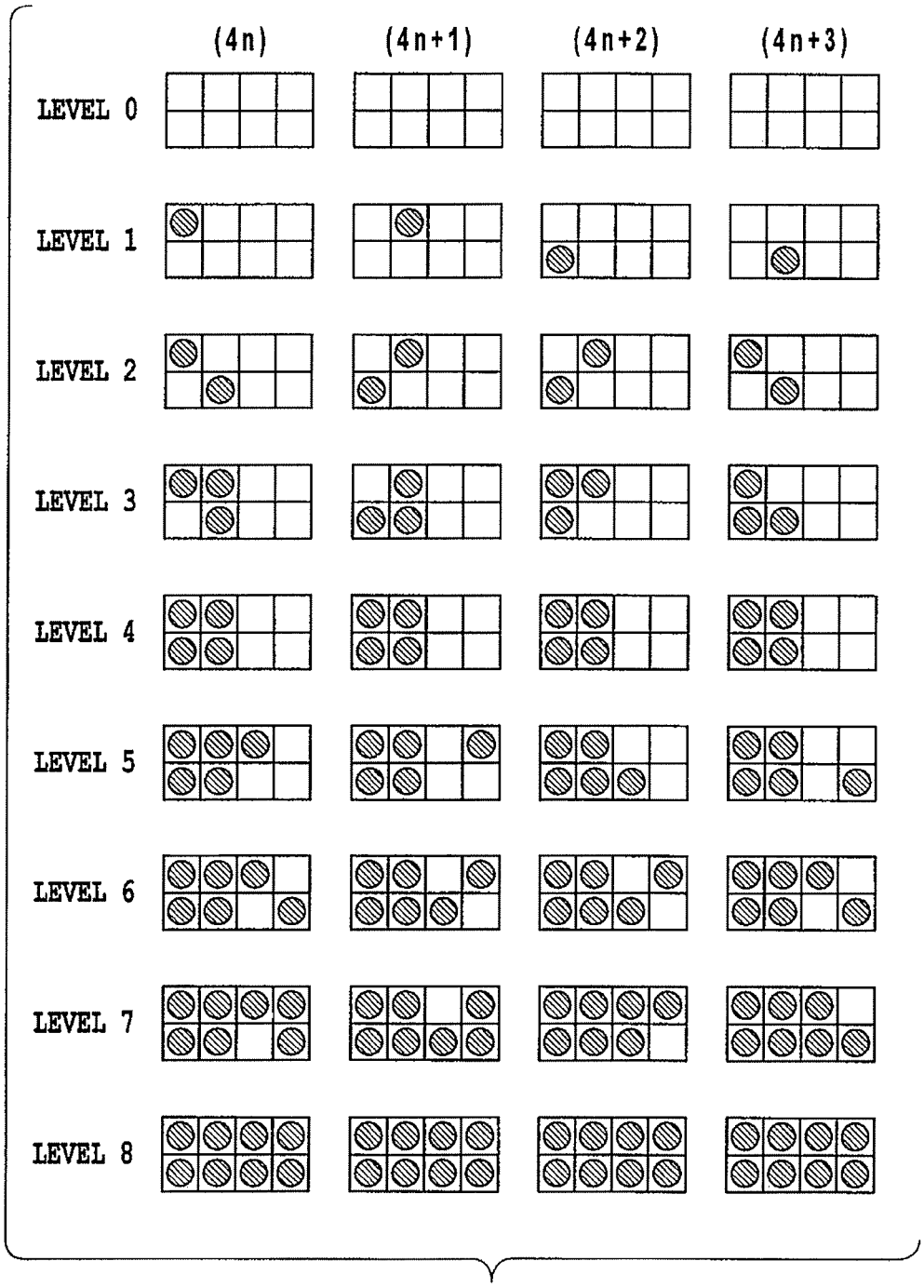
FIG. 2 illustrates output patterns that dot arrangement patterning processing of the embodiment produces for input levels 0-8.

FIG. 2 shows output patterns that the dot arrangement patterning of this embodiment generates for input levels 0-8. The levels shown to the left of the figure correspond to level 0 to level 8, output from the half toning on the host device. Areas shown to the right, each made up of 2 vertical sub-areas by 4 horizontal sub-areas, constitute one pixel area output by the half toning. Each of the sub-areas in one pixel represents a minimum unit area in which a dot on/off is defined. In this specification the "pixel" refers to a minimum unit area that can be represented in grayscale and which constitutes a minimum unit that is handled by two- or more-bit, multivalued data image processing (e.g., the preprocessing, post processing, γ correction and half toning).

In the figure, sub-areas marked with a circle represent those where a dot is to be printed. As the level increases, the number of dots in one pixel increases one at a time. In this embodiment, the density information of an original image is reflected in this manner.

(4n) to (4n+3) represent horizontal pixel positions from the left end of the image data which are determined by substituting an integer equal to 1 or more into n. Dot patterns presented in these columns show that four different dot patterns are prepared for one and the same input level according to pixel position. That is, if the same input level is entered, four dot arrangement patterns shown in the columns (4n) to (4n+3) are cyclically allotted.

In FIG. 2 the vertical direction is taken to be a direction in which nozzle openings of the print head are arrayed and the horizontal direction is taken to be a direction of scan of the print head. Printing the same level of print data in a plurality of different dot arrangements produces an effect of dispersing the number of ejections among the nozzles situated in the upper tier of the dot arrangement pattern and the nozzles situated in the lower tier and also an effect of spreading various noise characteristic of the printing apparatus.

With the above dot arrangement patterning completed, all dot arrangement patterns to be printed on the print medium are determined.

(G) Mask Data Conversion

The above dot arrangement patterning J0007 determines the presence or absence of dot in individual sub-areas on the print medium. Thus, entering binary data representing the dot arrangement to a drive circuit J0009 of the print head H1001 enables a desired image to be printed. In printing the image, a so-called 1-pass printing is executed which completes the printing of one and the same scan area of the print medium in a single scan. Here, we take for example a multi-pass printing which completes the printing on the same scan area on the print medium in multiple scans.

Figure 3:
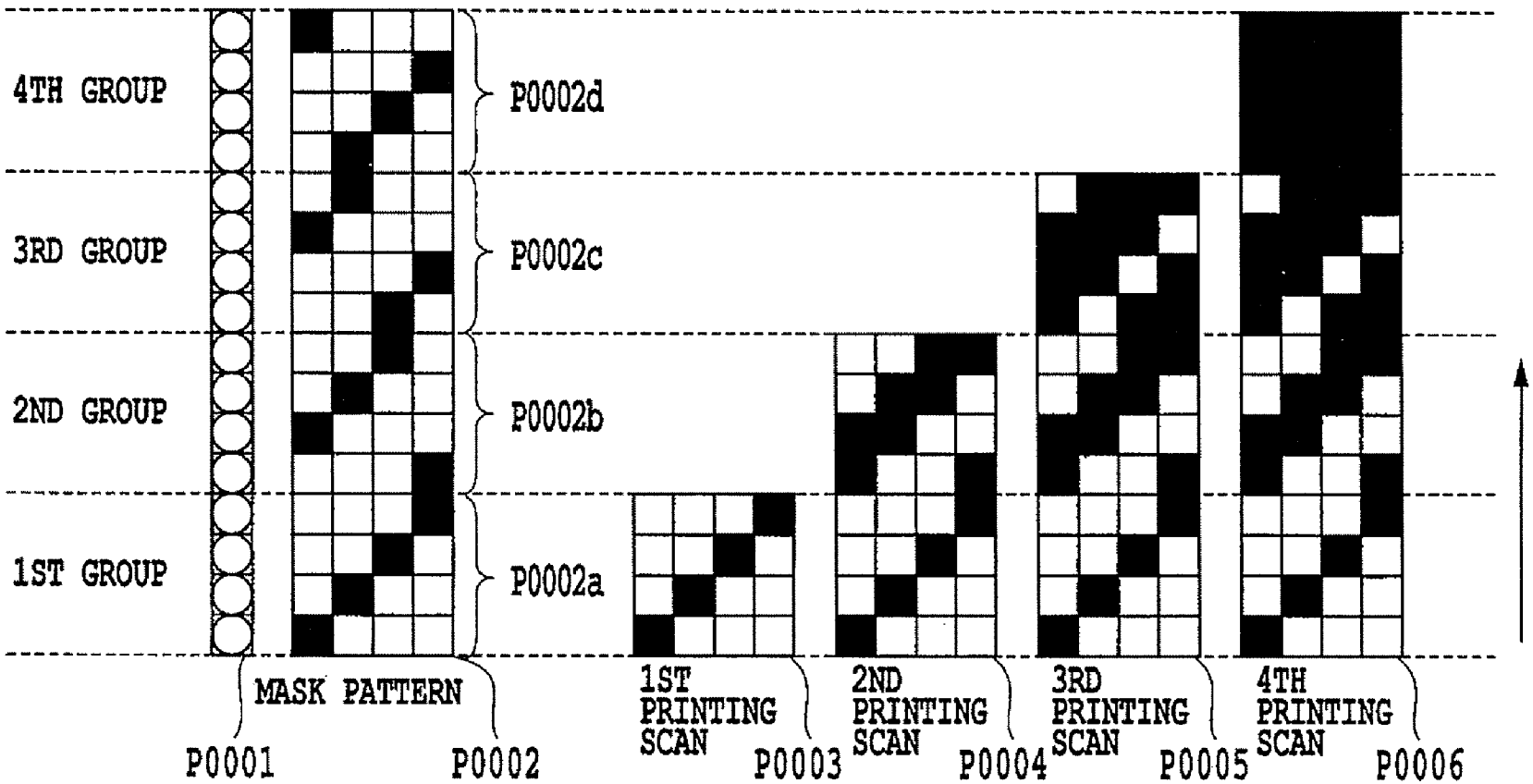
FIG. 3 schematically illustrates a print head and printed patterns to explain a multipass printing method.

FIG. 3 schematically shows a print head and print patterns to explain the multipass printing method. The print head H1001 used in this embodiment has 768 nozzles. For the sake of simplicity, the print head is described as a print head P0001 having 16 nozzles. The nozzles are divided into four nozzle groups, first to fourth nozzle group, as shown in the figure, with each nozzle group having four nozzles. A mask pattern P0002 comprises first to fourth mask pattern P0002*a*-P0002*d*. The first to fourth mask pattern P0002*a*-P0002*d* each defines areas that the first to fourth nozzle group can print. Areas in the mask pattern that are painted black represent print permission area and blank areas represent print non-permission areas. The first to fourth mask pattern P0002*a*-P0002*d* are complementary to one another and superimposing these four mask patterns completes the printing of a 4×4 area.

Patterns at P0003-P0006 show how an image is formed as the overlapping printing scans are performed. Each time the printing scan is completed, the print medium is fed a width of each group in the direction of an arrow in the figure (in this figure, a distance equal to four nozzles). Therefore, an image in one and the same area of the print medium (an area corresponding to the width of each nozzle group) is completed in four printing scans. As described above, forming an image in each area of the print medium in a plurality of scans by a plurality of nozzle groups has an effect of reducing variations characteristic of nozzles and feeding accuracy variations of the print medium.

Figure 4:
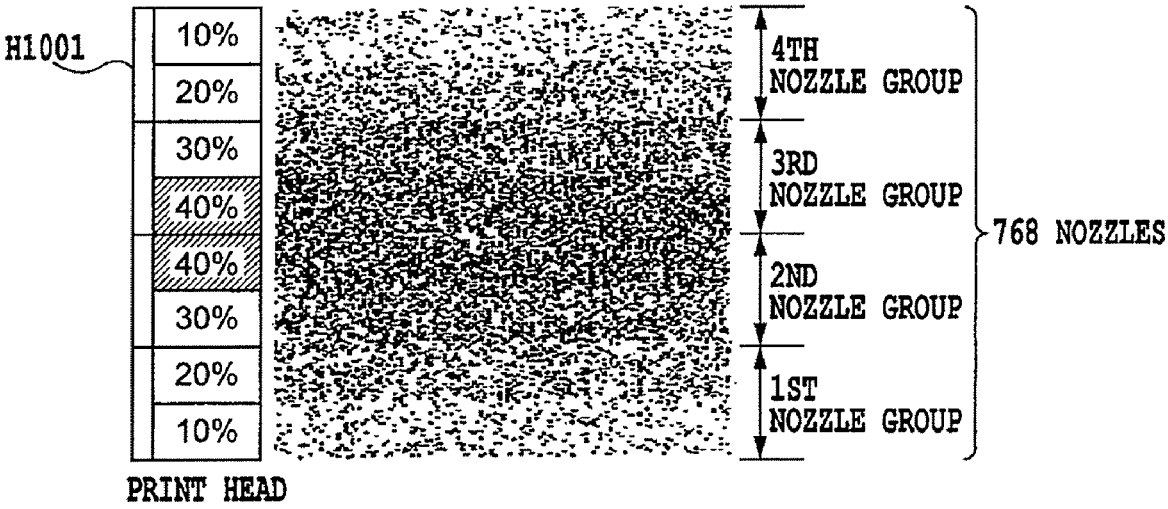
FIG. 4 illustrates one example of mask pattern applicable to the embodiment.

FIG. 4 shows one example of mask pattern applicable to this embodiment. A print head J0010 used in this embodiment has 768 nozzles, which are divided into four groups of 192 nozzles. The mask pattern measures 768 vertically extending sub-areas by 256 horizontally extending sub-areas. Four mask patterns corresponding to the four nozzle groups are complementary to one another.

In this embodiment, the mask data shown in FIG. 4 is stored in a memory in the printing apparatus. The mask data conversion J0008 executes an AND operation on the mask data and the binary data obtained by the dot arrangement patterning to determine binary data to be printed in each printing scan and sends it to the drive circuit J0009, which in turn drives the print head J0010 to eject ink according to the binary data.

In FIG. 1, the preprocessing J0002, post processing J0003, γ correction J0004, half toning J0005 and print data generation J0006 are executed by the host device J0012. The dot arrangement patterning J0007 and the mask data conversion J0008 are executed by the printing apparatus J0013. It is noted, however, that the present invention is not limited to this embodiment. For example, a part of above processing J002-J0005 may be executed by the printing apparatus J0013, or all of processing J002-J0008 may be executed by the host device J0012. Alternatively, the processing J002-J0008 may be executed by the printing apparatus J0013.

1.2 Construction of Mechanical Unit

The construction of the printing apparatus applied to this embodiment will be described as follows. The printing apparatus of this embodiment generally comprises, in terms of function, a paper supply unit, a paper transport unit, a paper discharge unit, a carriage unit and a cleaning unit, and these units are accommodated in and protected by an enclosure.

Figure 5:
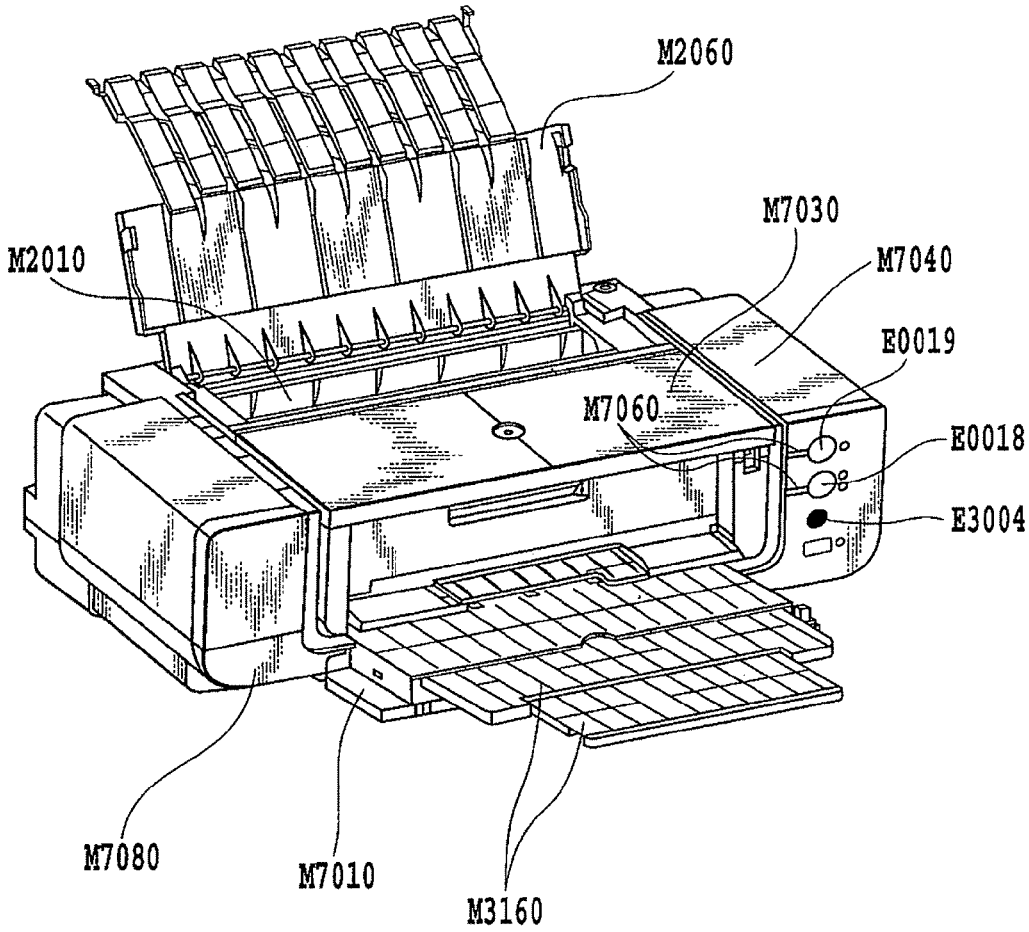
FIG. 5 is a perspective view of a printing apparatus applicable to the embodiment of this invention, as seen diagonally from a right upper part of the printing apparatus.

FIG. 5 is a perspective view of the printing apparatus as seen diagonally from its right upper portion. An enclosure of the printing apparatus comprises mainly a lower case M7080, an upper case M7040, an access cover M7030, a connector cover not shown and a front cover M7010, enclosing an internal construction of the apparatus. The upper case M7040 is provided with an LED guide M7060 that transmits and displays LED light, a power key E0018, a resume key E0019 and a flat pass key E3004. A paper supply tray M2060 and a paper discharge tray M3160 are pivotally mounted and, when paper is supplied and discharged, can be extended stepwise as shown. When paper supply and discharge are not performed, they are folded to cover the apparatus.

Figure 6:
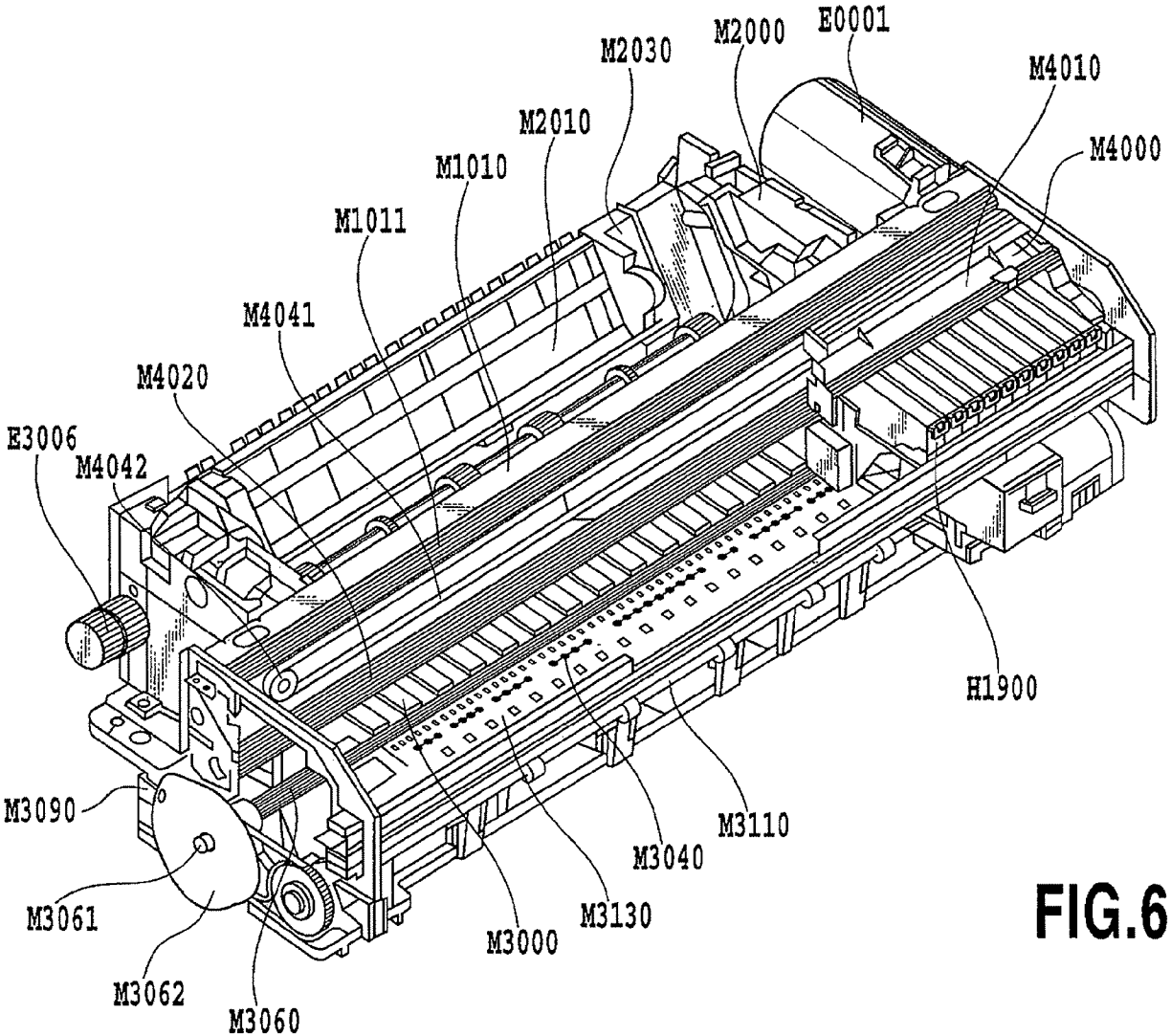
FIG. 6 is a perspective view of the printing apparatus applicable to the embodiment of this invention, showing an internal construction of the printing apparatus.
Figure 7:
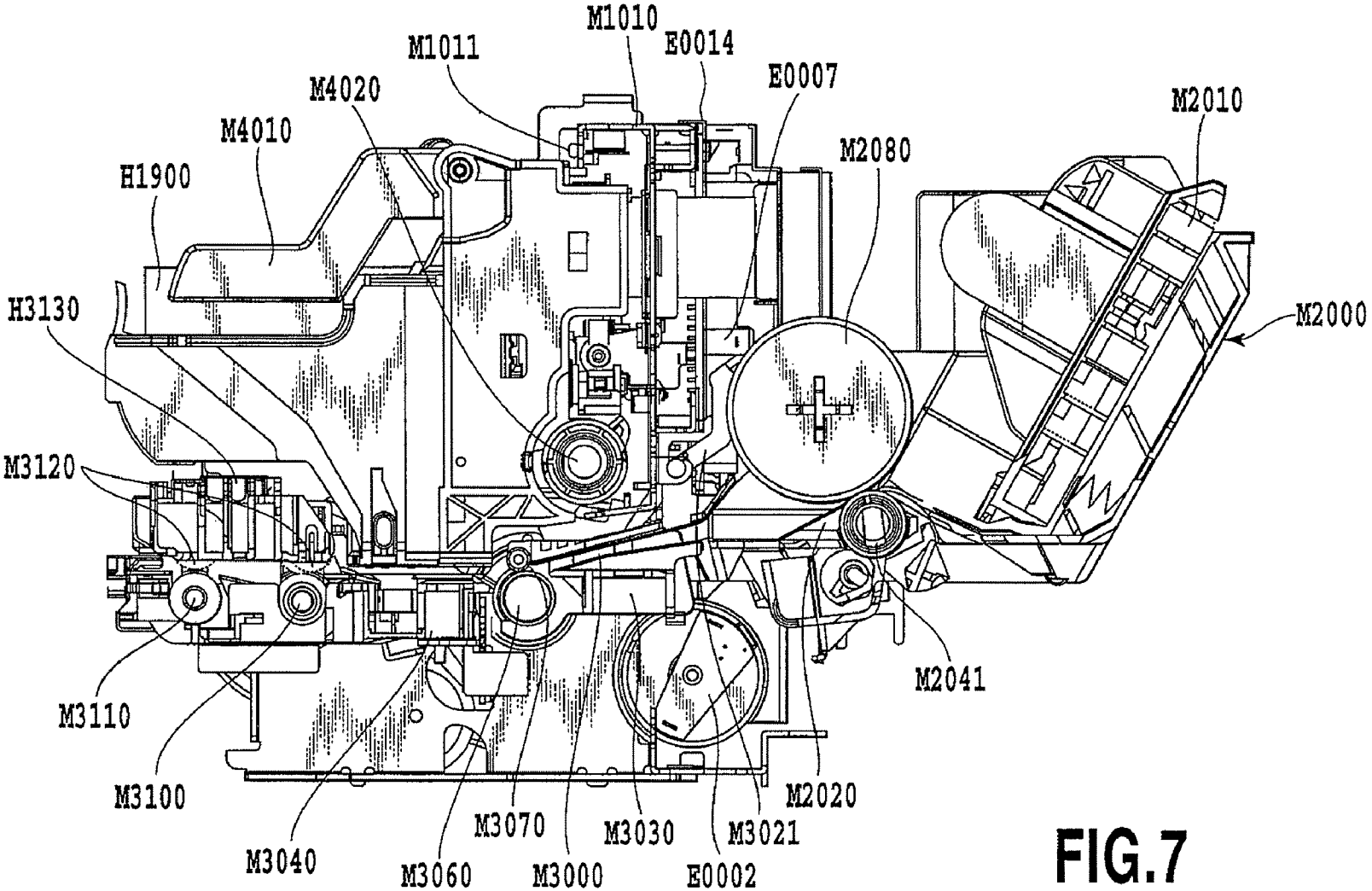
FIG. 7 is a perspective view of the printing apparatus applicable to the embodiment of this invention, showing an internal construction of the printing apparatus.

FIG. 6 is a perspective view of the printing apparatus with the enclosure removed. FIG. 7 is a cross-sectional view of the apparatus.

A base M2000 has mounted thereon a pressure plate M2010 on which to put a stack of print medium sheets, a paper supply roller M2080 to feed sheets of print medium one at a time, a separation roller M2041 to separate a sheet from the stack and a return lever M2020 to return a print medium to the stack position, all combining to form a paper supply mechanism.

A chassis M1010 formed of a bent metal sheet has pivotally mounted thereon a transport roller M3060 to transport the print medium and a paper end sensor E0007.

The transport roller M3060 has a plurality of follower pinch rollers M3070 pressed against it. The pinch rollers M3070 are supported on a pinch roller holder M3000 and biased by pinch roller springs not shown so that they are pressed against the transport roller M3060 to generate a print medium transport force.

In a path along which the print medium is transported, a paper guide flapper M3030 to guide the print medium and a platen M3040 are installed. The pinch roller holder M3000 is attached with a PE sensor lever M3021 which transmits a timing signal indicating when it has detected the front and rear end of the print medium to the PE sensor E0007 fixed on the chassis M1010.

The drive force for the transport roller M3060 is provided by an LF motor E0002, which may be a DC motor for example, whose rotating force is transmitted through a timing belt to a pulley M3061 arranged on a shaft of the transport roller M3060. Also on the shaft of the transport roller M3060, there is a code wheel M3062 for detecting a transport distance of the print medium transported by the transport roller M3060. On the adjoining chassis M1010 is installed an encode sensor M3090 to read a marking formed on the code wheel M3062.

A first discharge roller M3100, a second discharge roller M3110, a plurality of spurs M3120 and a gear train combine to form the paper discharge mechanism. A drive force for the first discharge roller M3100 is provided by the transport roller M3060 whose rotating force is transmitted through idler gears. A drive force for the second discharge roller M3110 is provided by the first discharge roller M3100 whose rotating force is conveyed through idler gears.

The spurs M3120 is formed of a circular thin plate integrally molded with a resin portion which has a plurality of protrusions along its circumference. Two or more of them are mounted on the spur holder M3130.

The print medium with a printed image is nipped and transported by the second discharge roller M3110 and spurs M3120 and discharged onto the paper discharge tray M3160.

Denoted M4000 is a carriage on which to mount the print head H1001 and which is supported on a guide shaft M4020 and a guide rail M1011. The guide shaft M4020 is mounted on the chassis M1010 and guides the carriage M4000 for reciprocal scan in a direction crossing the transport direction of the print medium. The guide rail M1011 is formed integral with the chassis M1010 and holds a rear end portion of the carriage M4000 to maintain a predetermined gap between the print head H1001 and the print medium.

The carriage M4000 is reciprocally driven by a carriage motor E0001 on the chassis M1010 through a timing belt M4041 that is stretched and supported by an idle pulley M4042.

An encoder scale (not shown) formed with markings at a predetermined pitch is arranged parallel to the timing belt M4041. An encoder sensor on the carriage M4000 reads the marking on the encoder scale. A present position of the carriage M4000 can be identified based on the detected value of the encoder sensor.

The print head H1001 of this embodiment has ink tanks H1900 for 10 color inks removably mounted thereon. The print head H1001 is removably mounted on the carriage M4000. The carriage M4000 has an abutment portion to position the print head H1001 and a pressing means mounted on a head set lever M4010.

In forming an image on a print medium using the above construction, the following procedure is taken. As for the row position, the print medium is transported and positioned by a pair of rollers made up of the transport roller M3060 and pinch rollers M3070. As for the column position, the carriage M4000 is moved by the carriage motor E0001 in a direction perpendicular to the transport direction to locate the print head H1001 at a target image forming position. The print head H1001 thus positioned then ejects ink according to a signal received from the main printed circuit board E0014.

In the printing apparatus of this embodiment, an image is formed on the print medium successively by repetitively alternating the printing action of the print head in the main scan direction and the feeding of the print medium in the subscan direction.

1.3 Electric Circuit Configuration

Figure 8:
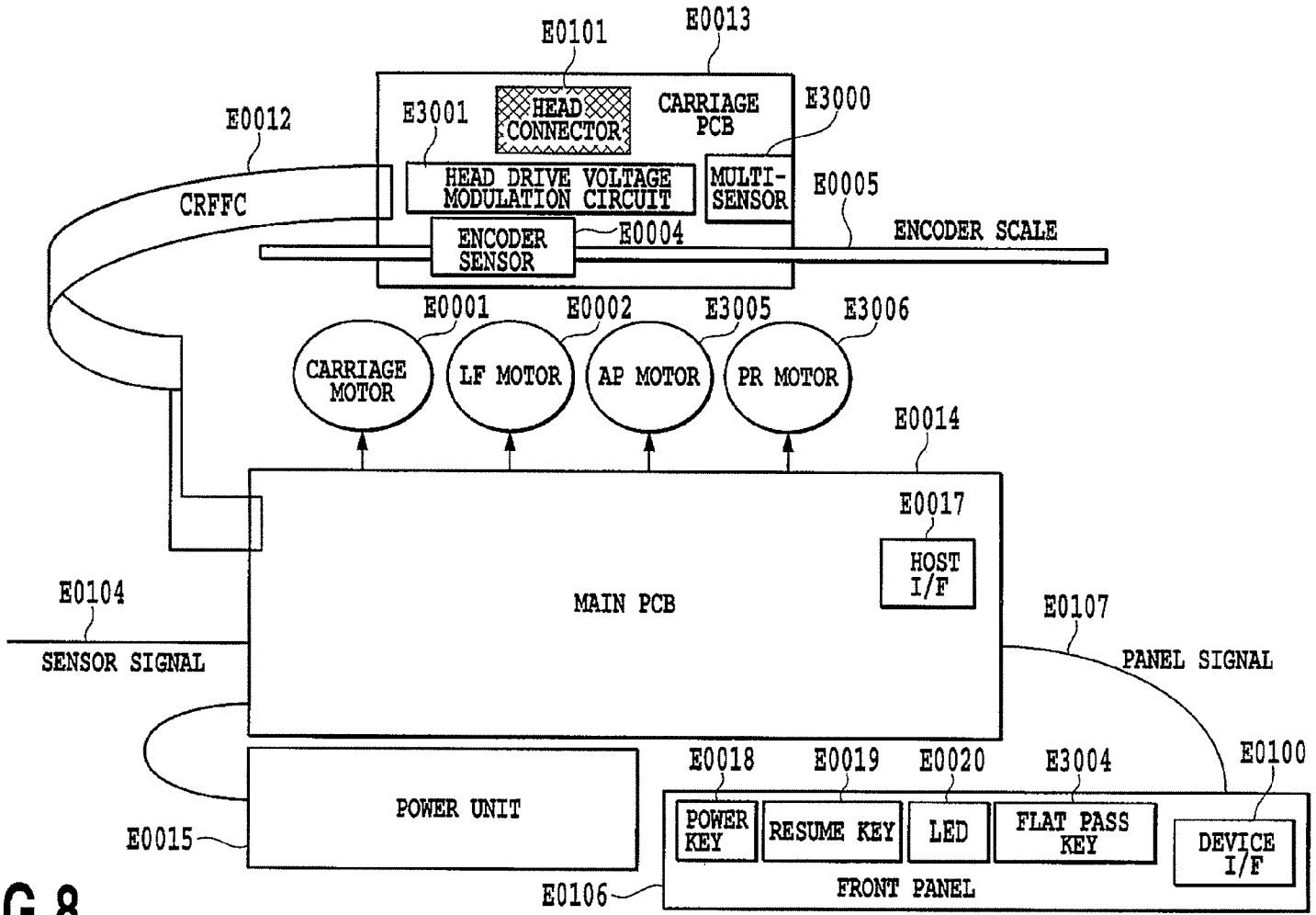
FIG. 8 is a block diagram schematically showing an overall configuration of an electric circuit in the ink jet printing apparatus applied to the embodiment of this invention.

FIG. 8 is a block diagram schematically showing an electric circuitry of the printing apparatus J0013. The electric circuit of this embodiment mainly comprises a carriage printed circuit board E0013, a main printed circuit board E0014, a power unit E0015 and a front panel E0106.

The power unit E0015 is connected to the main printed circuit board E0014 to supply electricity to various drive units.

The carriage printed circuit board E0013 is mounted on the carriage M4000 and has an interface function, including transferring signals to and from the print head H1001 through a head connector E0101 and supplying a head drive power. A head drive voltage modulation circuit (voltage adjustment circuit) E3001 controls the power supply to the print head and has a plurality of channels corresponding to a plurality of color nozzle columns mounted on the print head H1001. According to signals received from the main printed circuit board E0014 through a flexible flat cable (CRFFC) E0012, the head drive voltage modulation circuit E3001 generates a head drive voltage for each channel. The encoder sensor E0004 reads a pattern of the encoder scale E0005 fixed in the printing apparatus as the carriage M4000 moves during the scan, and then transmits a reading in the form of a pulse signal to the main printed circuit board E0014 through the flexible flat cable (CRFFC) E0012. Based on this output signal, the main printed circuit board can detect the position of the encoder sensor E0004 with respect to the encoder scale E0005, i.e., the position of the carriage.

The carriage printed circuit board E0013 is connected with an optical sensor made up of two light emitting devices and two light receiving devices and also with a thermistor that detects an ambient temperature (these sensors are generally referred to as a multisensor E3000). Information acquired by the multisensor E3000 is output through the flexible flat cable (CRFFC) E0012 to the main printed circuit board E0014.

Main printed circuit board E0014 controls various drive units in the ink jet printing apparatus. The main printed circuit board E0014 has a host interface (host I/F) E0017 for data transfer to and from the host computer not shown and performs a print control according to the data received through the host interface.

The main printed circuit board E0014 is connected with the carriage motor E0001, LF motor E0002, AP motor E3005 and PR motor E3006 and controls these motors. The carriage motor E0001 is a drive source for the main scan of the carriage M4000. The LF motor E0002 is a drive source for the transport of the print medium. The AP motor E3005 is a drive source for the recovery operation of the print head H1001 and for the supply of the print medium. The PR motor E3006 is a drive source for the flat pass (horizontal transport).

Further, the main printed circuit board E0014 is connected to a sensor signal E0104 and receives output signals from the PE sensor, CR lift sensor, LF encoder sensor and PG sensor that represent operation states of various portions and transmits control signals according to the sensor signals.

The main printed circuit board E0014 is connected to the CRFFC E0012 and the power unit E0015. It also has an interface for data transfer to and from the front panel E0106 through a panel signal E0107.

The front panel E0106 is a unit installed at the front of the printing apparatus body for easy operation on the part of the user. This unit has a resume key E0019, LED E0020, power key E0018 and flat pass key E3004. It also has a device I/F E0100 for connection with peripheral devices such as digital camera.

Figure 9:
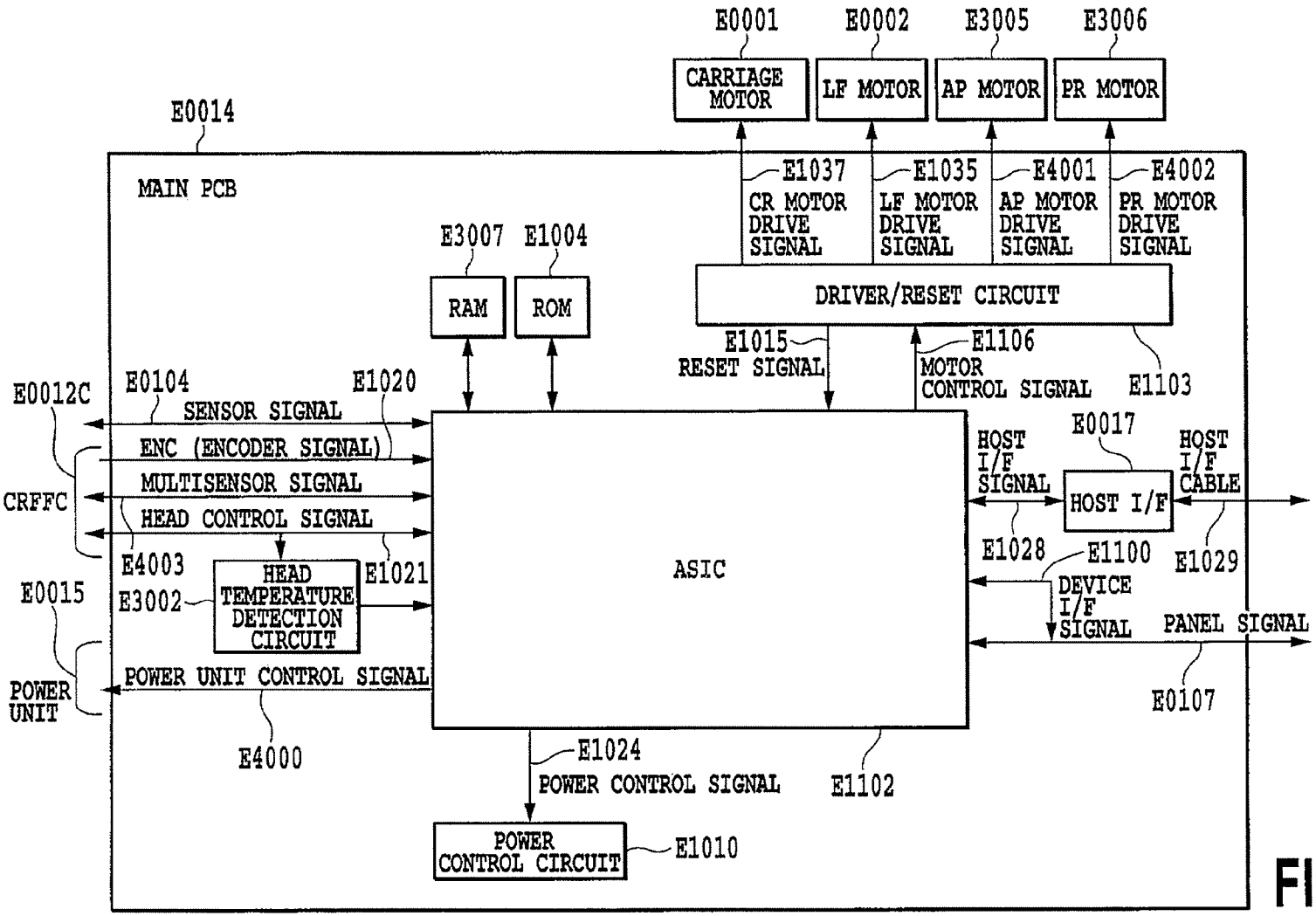
FIG. 9 is a block diagram showing an internal configuration of a main printed circuit board in the ink jet printing apparatus applied to the embodiment of this invention.

FIG. 9 is a block diagram showing an internal configuration of the main printed circuit board E0014. In the figure, denoted E1102 is an ASIC (Application Specific Integrated Circuit). ASIC E1102 includes a so-called CPU. The ASIC E1102 performs various controls on the printing apparatus as a whole according to programs stored in a ROM E1004 connected to it through control bus E1014. In addition to programs, the ROM E1004 also stores parameters and tables used in controlling various mechanical units. Tables include information about waveforms (amplitudes and pulse widths) of pulse signals that drive the print head, as shown in FIG. 24. The ASIC E1102 controls the operation of the printing apparatus as a whole by performing various settings and logic operations and making condition judgment by referring to parameters stored in the ROM E1004 as required. At this time a RAM E3007 is used as a data buffer for printing and for receiving data from the host computer and also as a work area necessary for various controls.

Image data entered from the device I/F E0100 is transmitted as a device I/F signal E1100 to the ASIC E1102. Image data that the host I/F E0017 receives from the host device through a host I/F cable E1029 is sent as a host I/F signal E1028 to the ASIC E1102. Upon receiving these image data, the ASIC E1102 performs a printing operation based on various detection signals and setting signals.

Data detected by various sensors in the printing apparatus are transmitted as the sensor signal E0104 to the ASIC E1102. A signal E4003 from the multisensor E3000, a signal E1020 from the encoder sensor E0004, a temperature signal from the print head and a heater rank of each nozzle column of the print head are also transferred to the ASIC E1102 through the CRFFC E0012. The temperature signal of the print head is amplified by a head temperature detection circuit E3002 on the main printed circuit board before being input to the ASIC E1102. The ASIC E1102 acquires the temperature signal periodically. Further, data from the power key E0018, resume key E0019 and flat pass key E3004 on the front panel E0106 are also supplied as the panel signal E0107 to the ASIC E1102. The ASIC E1102 uses these input signals as decision factors to issue control signals to various mechanical units.

For example, based on the position information from the encoder signal E1020 and the temperature information from the head temperature detection circuit E3002, the ASIC E1102 outputs a head control signal E1021 for the control of the ejection timing and ejection volume. This head control signal E1021 is supplied to the print head H1001 through the head drive voltage modulation circuit E3001 and the head connector E0101, both explained in FIG. 8.

E1103 is a driver/reset circuit. The ASIC E1102 issues a motor control signal E1106 for various motors to the driver/reset circuit E1103. According to the received motor control signal E1106, the driver/reset circuit E1103 generates a CR motor drive signal E1037, an LF motor drive signal E1035, an AP motor drive signal E4001 and a PR motor drive signal E4002 to drive the associated motors. The driver/reset circuit E1103 has a power supply circuit and supplies electricity to the main printed circuit board E0014, carriage printed circuit board E0013 and front panel E0106. When a power supply voltage drop is detected, the driver/reset circuit E1103 generates a reset signal E1015 and initializes the mechanical units.

Denoted E1010 is a power supply control circuit which controls the power supply to various sensors having light emitting devices according to a power supply control signal E1024 from the ASIC E1102.

The power for main printed circuit board E0014 is supplied by the power unit E0015. When a voltage transformation is required, the power is voltage-transformed before being supplied to various parts in and out of the main printed circuit board E0014. A power unit control signal E4000 from the ASIC E1102 is connected to the power unit E0015 to allow a switch to a low power consumption mode of the printing apparatus.

1.4 Print Head Construction

Figure 10:
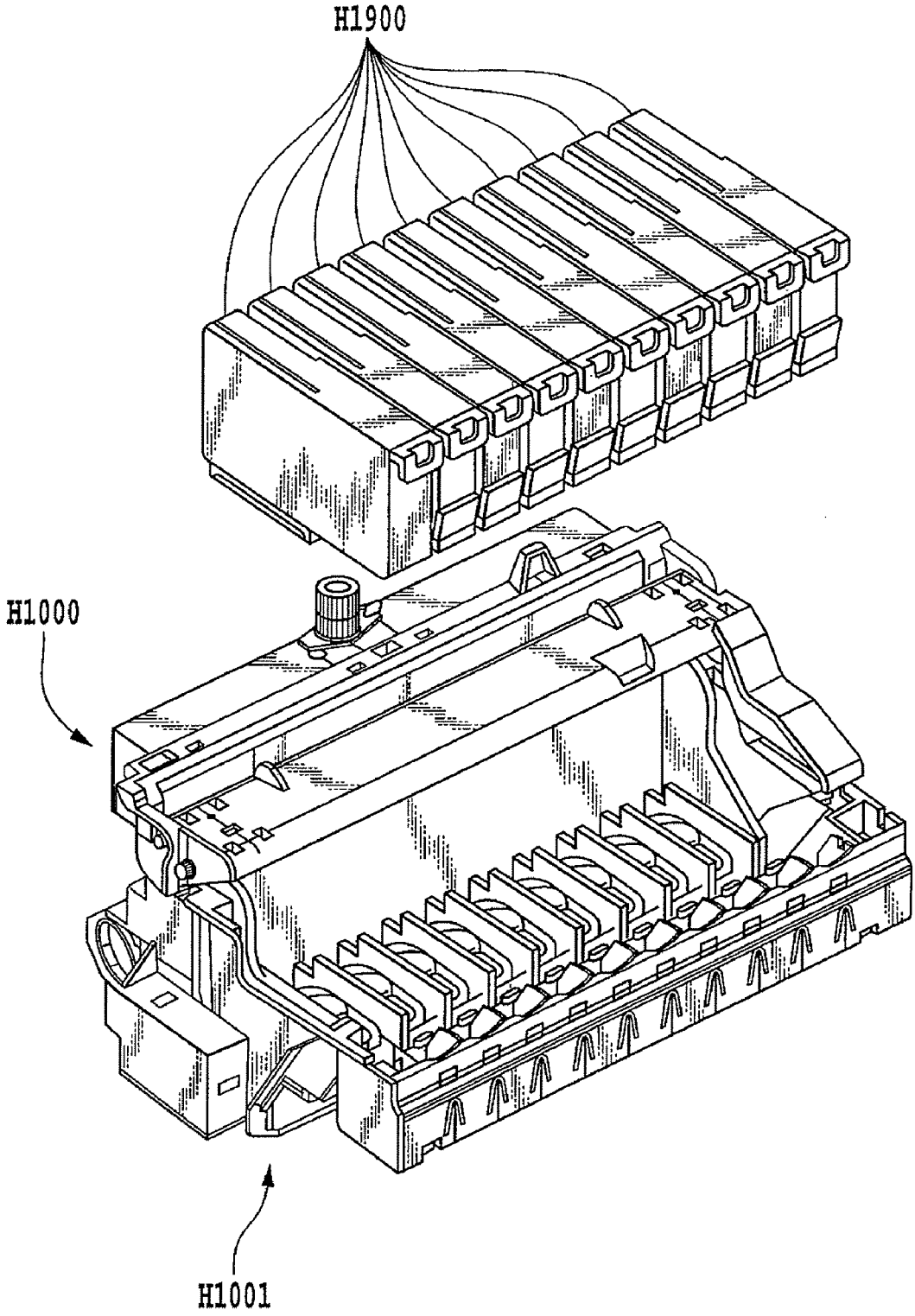
FIG. 10 is a schematic view showing a construction of a head cartridge applied to the embodiment of this invention.

FIG. 10 is a schematic perspective view showing a construction of the head cartridge H1000 applied to this embodiment. The head cartridge H1000 of this embodiment has a means in which to mount the print head H1001 and the ink tanks H1900 and a means to supply ink to the print head. The head cartridge H1000 is removably mounted in the carriage M4000.

This embodiment provides an ink tank H1900 for each of 10 color inks. Each of the ink tanks is removably mounted on the head cartridge H1000. The mounting and dismounting of the ink tanks H1900 can be done with the head cartridge H1000 mounted in the carriage M4000.

The print head H1001 has heaters (electrothermal transducers) installed one in each ink path communicating to an ink ejection opening and ejects ink by using a thermal energy of the heaters. More specifically, a drive voltage is applied to a heater to rapidly heat ink in the ink path to form an expanding bubble which in turn expels ink from a nozzle opening.

Figure 11:
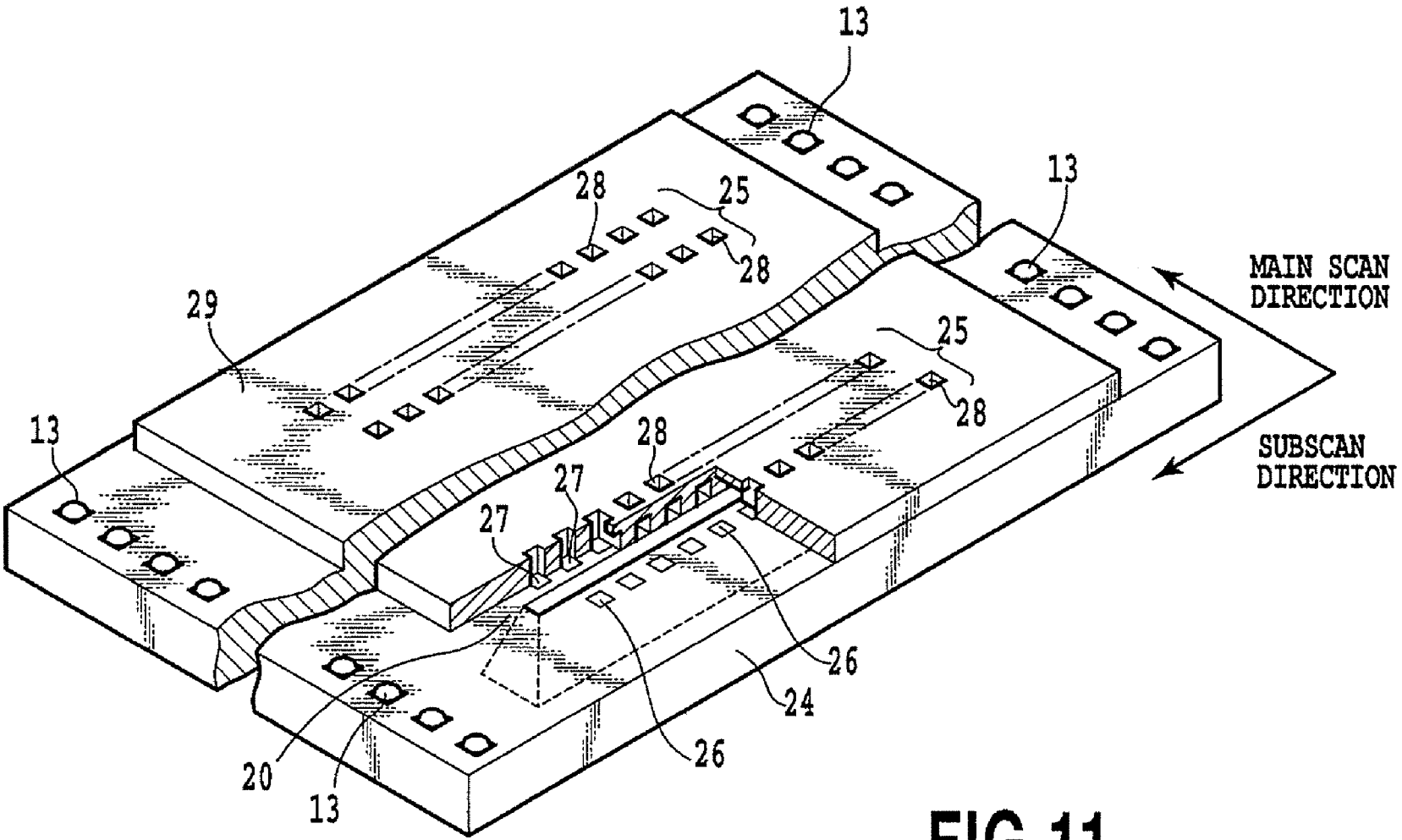
FIG. 11 is a schematic perspective view showing a structure of an ejecting portion of the print head used in the embodiment of this invention.

FIG. 11 is a schematic perspective view showing a structure of an ejecting portion of the print head H1001. In the figure, denoted 24 is a substrate formed of a silicon wafer. The substrate 24 constitutes a part of an ink path member and also functions as a support for a layer that forms the heaters, the ink paths and the nozzle openings. In this embodiment, the substrate 24 may use other materials than silicon, such as glass, ceramics, plastics or metals.

On the substrate 24 heaters 26 as a thermal energy generation means are arrayed at a pitch of 600 dpi in the subscan direction on both sides of an ink supply port along its length. These two columns of heaters are staggered a half pitch in the subscan direction.

On the substrate 24 is bonded a cover resin layer 29 that introduces ink to the individual heaters. Formed in the cover resin layer 29 are flow paths (or liquid paths) 27 at positions corresponding to individual heaters and a common ink supply port 20 capable of supplying ink to the individual flow paths 27. Front end portions of the flow paths 27 constitute nozzle openings from which an ink droplet caused by the film boiling formed by the heater 26 is ejected. Denoted 13 are electrodes to apply a voltage pulse to the individual heaters 26.

In the above construction, applying a voltage to the individual heaters at a predetermined timing as the print head moves in the main scan direction enables ink droplets supplied from the same ink supply port 20 to be printed onto the print medium at a resolution of 1,200 dpi in the subscan direction.

One ink supply port 20 is supplied one ink and a plurality of such ink supply ports 20 are parallelly formed in one substrate 24 and can eject different inks. Although two columns of print elements (two nozzle columns) are shown in the figure, the print head of this embodiment actually has five nozzle columns in one substrate capable of ejecting five inks. Two such substrates are arranged side by side so that the print head of this embodiment can eject 10 color inks.

Though not shown, the print head substrate 24 of this embodiment has arranged thereon a diode sensor to detect a temperature. While a voltage pulse is applied to individual heaters, the diode sensor is susceptible to noise and thus can hardly make a precise temperature detection. So, in this embodiment the diode sensor performs the temperature detection between printing scans in the printing apparatus. The measured temperature data is transferred to the main printed circuit board through the head connector E0101 and CRFFC E0012.

The temperature of the substrate measured in this way (base temperature) can be deemed almost as the ink temperature. In this embodiment, to stabilize the ejection volume that is affected by the ink temperature, the base temperature is measured in each printing scan and used as a parameter for pulse setting in the next printing scan.

2. Characteristic Construction

The general construction of the printing apparatus of this embodiment has been described. Next, a construction characteristic of this invention will be described in detail. First, the head drive voltage modulation circuit to apply an appropriate voltage to the print head will be explained.

Referring to FIG. 8, the head drive voltage modulation circuit E3001 of this embodiment modulates an input voltage supplied from the power unit E0015 through the main printed circuit board E0014 to a voltage specified by the main printed circuit board and supplies the modulated voltage as an output voltage VH to the head connector E0101.

Figure 12:
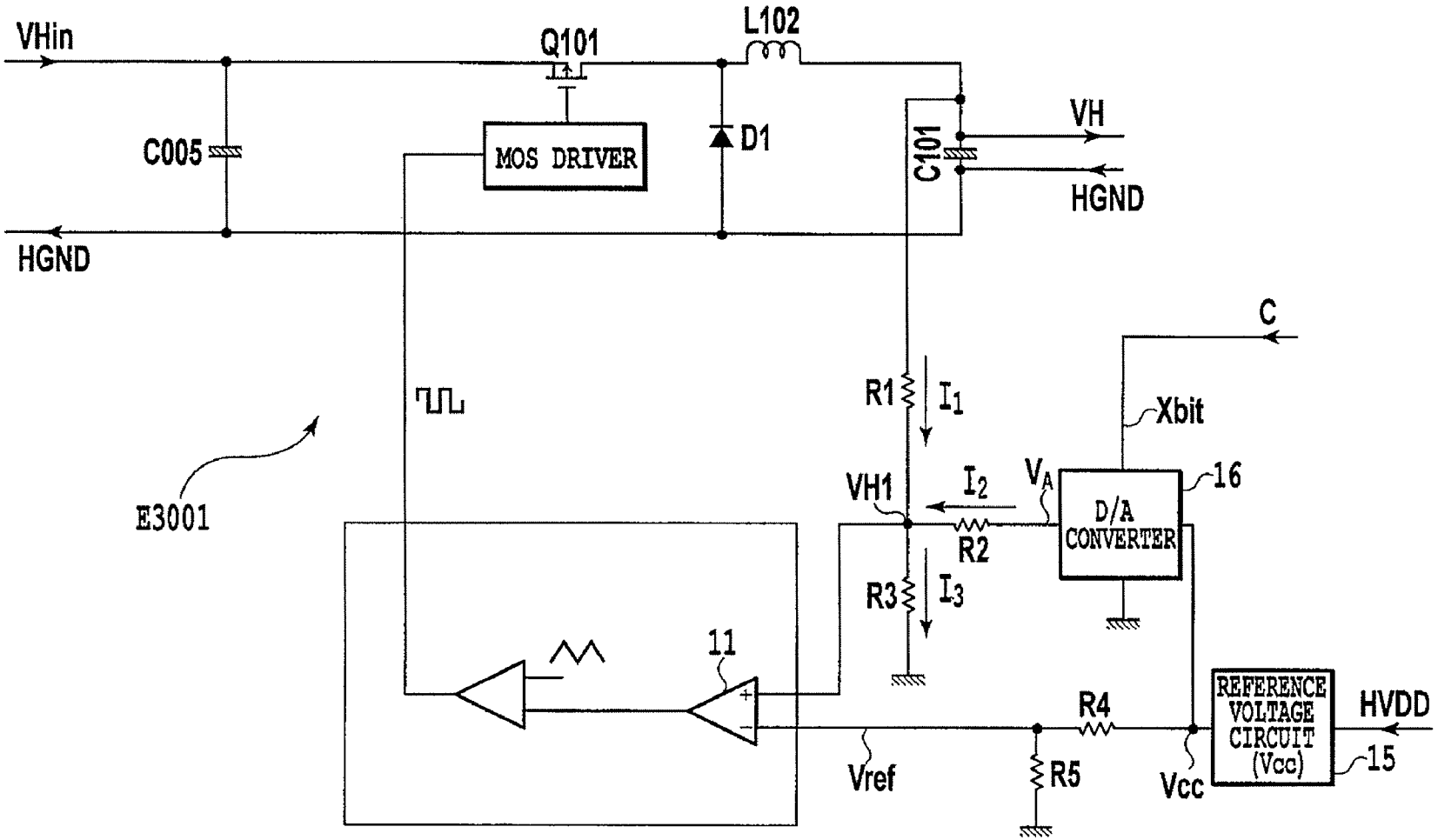
FIG. 12 is a circuit diagram showing an example configuration of a head drive voltage modulation circuit arranged on a carriage printed circuit board.

FIG. 12 is a circuit diagram showing an example configuration of the head drive voltage modulation circuit E3001 arranged on the carriage printed circuit board E0013. In the figure, denoted HVDD is a control signal to turn on/off a reference voltage circuit 15. Denoted C is an 8-bit control signal to set a voltage applied to the print head. Denoted VH is a voltage actually applied to the print head. A reference voltage VCC after being transformed by the reference voltage circuit 15 is entered into a D/A converter 16 where it is transformed to an output voltage VA according to the control signal C. Since the control signal C is an 8-bit digital signal, an output of the D/A converter 16 can be adjusted in 256 steps. Suppose, for example, the 8-bit control signal C has a value of X. Then, the output voltage VA of the D/A converter 16 is expressed as $$VA=Vcc\times X/256$$

A current I2 corresponding to the output voltage VA is added through a resistor R2 to a voltage dividing point between resistors R1 and R2. A voltage VH1 applied to a non-inverted terminal of a differential amplifier 11 is controlled to minimize a difference between it and a reference voltage Vref supplied to the inverted terminal. So, currents I1, I2, I3 flowing through resistors R1, R2, R3 are given as follows:

$$I1=(VH-V\mathrm{ref})/R1$$

$$I2=(VA-V\mathrm{ref})/R2$$

$$I3=V\mathrm{ref}/R3$$

Further, according to Kirchhoff's current law, $$I1+I2=I3$$

Therefore, $$(VH-V\mathrm{ref})/R1+(VA-V\mathrm{ref})/R2=V\mathrm{ref}/R3$$

And the output voltage VH is expressed as $$VH=V\mathrm{ref}+R1\times\{V\mathrm{ref}/R3+(V\mathrm{ref}-VA)/R2\}$$

That is, the ASIC E1102 can adjust the voltage VH applied to the print head by appropriately changing the control signal C to the D/A converter 16.

Figure 13:
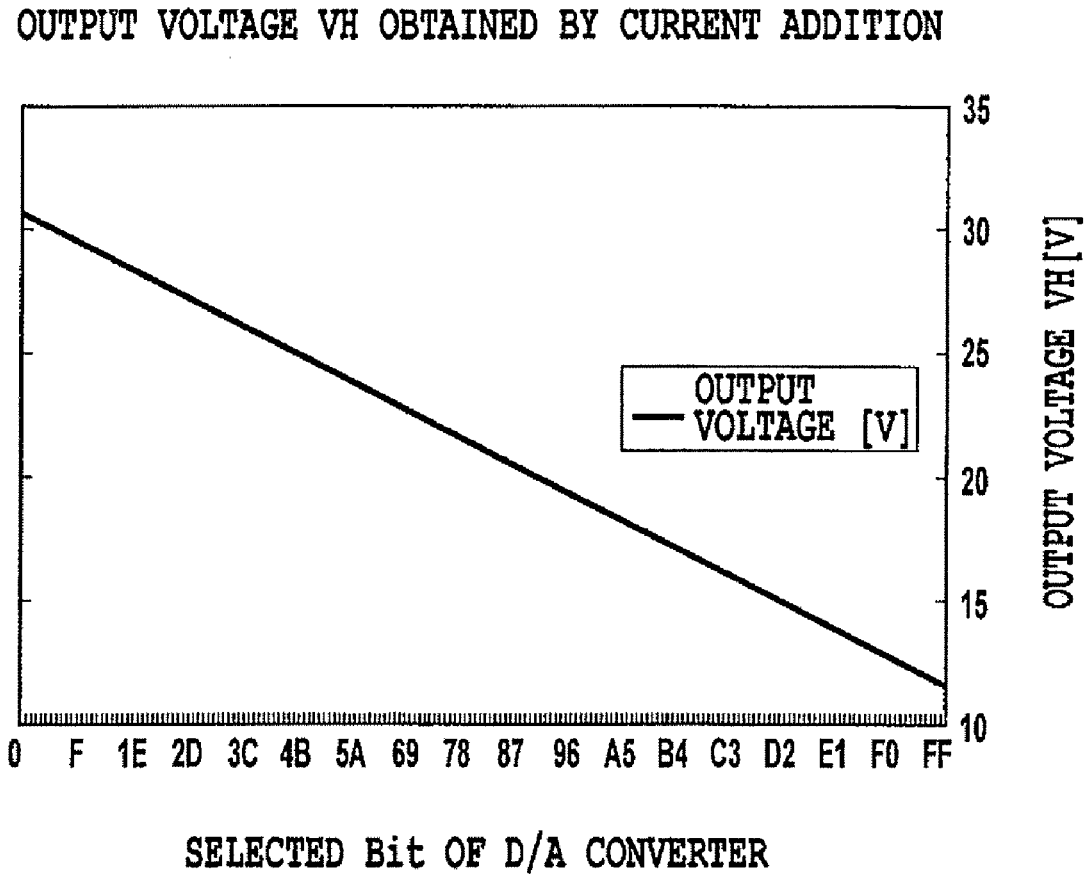
FIG. 13 is a diagram showing a relation between an input control signal C to a D/A converter and an output voltage VH.

FIG. 13 is a graph showing a relation between an input value of the control signal C to the D/A converter 16 and its output voltage VH. As can be seen from the above equations, in this case as the control signal C increases, the output voltage VH linearly decreases.

Next, the relation between a drive pulse and an ink ejection will be explained in detail for a case where the print head and the voltage modulation circuit of FIG. 11 and FIG. 12 are used. In the ink jet print head, to eject ink from individual nozzle openings requires imparting more than a predetermined amount of energy to each heater. The predetermined amount of energy is referred to as an energy threshold. The ejection will not occur unless the heater is given more than the energy threshold. When the heater is supplied energy by applying a pulse voltage to it, as in the print head of this embodiment, parameters that adjust the amount of energy include a pulse voltage value and a pulse width. In applying a predetermined amount of energy, the pulse voltage value and the pulse width have a relation in which increasing one of the two parameters results in the other becoming smaller.

As the pulse voltage value is changed with the pulse width kept at a fixed value P, a voltage Vth which is a threshold of whether ink is ejected or not and a voltage VOP at which stable ink ejection from all nozzles is ensured can be determined experimentally. Since there are variations in the state of heater surface of the print head, having a voltage just exceed Vth does not necessarily mean that stable ejection occurs from all nozzles. In the actual printing, therefore, it is general practice to apply a drive voltage VH based on the voltage VOP that ensures stable ejection from all nozzles. Here, the drive voltage VH can be expressed as $$VH=k\times Vth$$

In the above equation, k is expressed as a ratio of the drive voltage VH to the threshold voltage Vth with the pulse width P fixed. Generally, however, k is used as a parameter representing a ratio of drive energy to the energy threshold. In other words, keeping the k value constant means keeping the drive energy constant and it is therefore possible to use and adjust a relation between the drive voltage VH and the pulse width P by keeping the k value constant.

The k value is preferably set somewhat large in securing stable ejection. Continuing the application of too large an energy, however, could shorten the life of the heater. In general ink jet printing apparatus, therefore, the k value is adjusted to an appropriate value to ensure that stable ejection can be executed for as long a period as possible.

Changing the drive voltage VH and the pulse width P while holding them in a certain relationship can modulate an ejection volume under predetermined drive energy.

Figure 14:
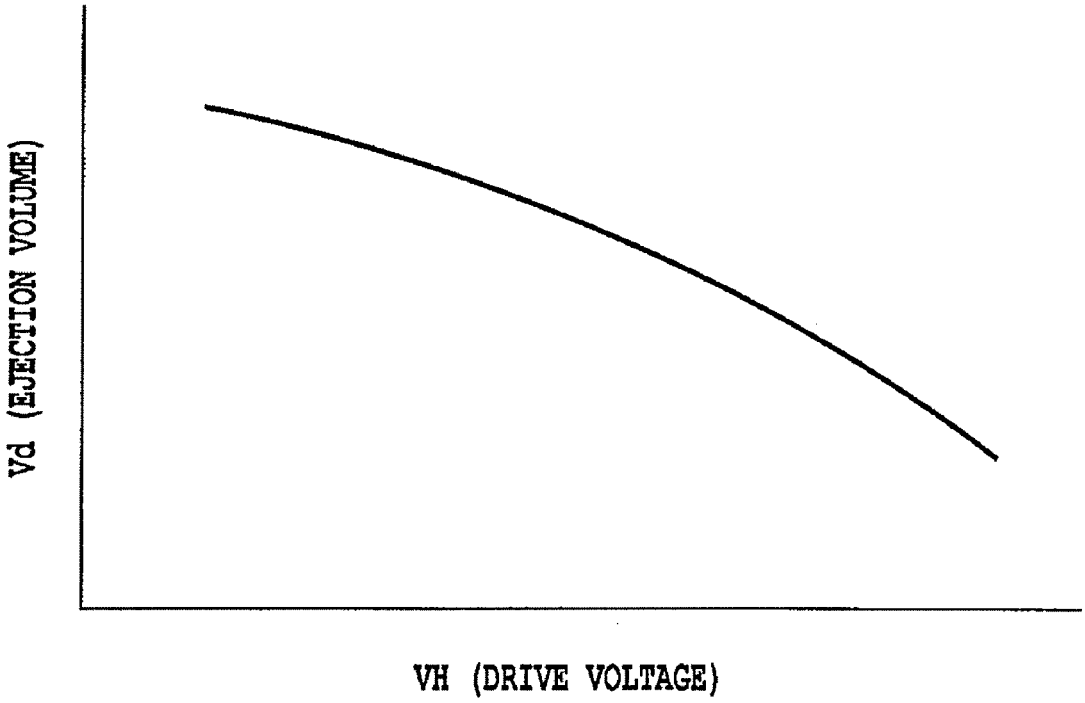
FIG. 14 illustrates how the ejection volume changes when the drive voltage to the heater is changed, with k kept constant.

FIG. 14 shows a change in the ejection volume Vd when the drive voltage VH to the heater is changed, with k fixed at 1.15. As can be seen from the diagram, the ejection volume decreases as the applied voltage increases. This is considered due to the fact that since the k value is constant, the pulse width decreases as the drive voltage VH increases. A shorter pulse width means a shorter time in which the heat of the heater can be transmitted to the ink and a smaller amount of ink that can be heated enough to contribute to the bubble generation.

Figure 15:
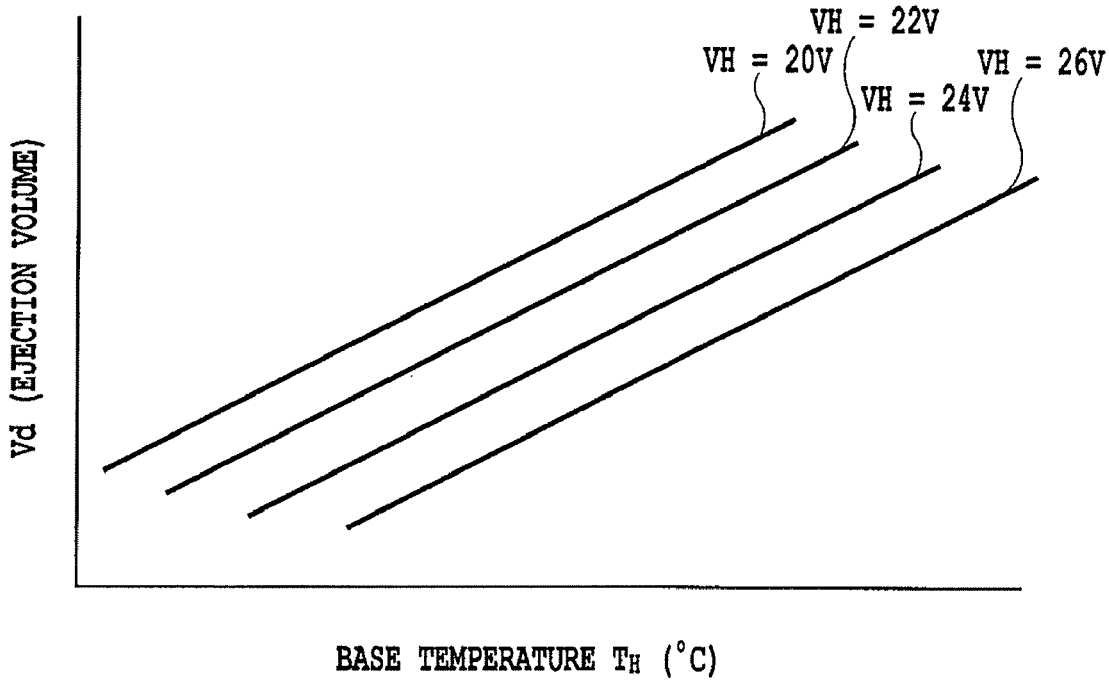
FIG. 15 is a graph showing a relation between a base temperature of the print head and an ejection volume.

FIG. 15 shows a relation between the temperature of the print head substrate (base temperature) and the ejection volume. As already explained with reference to FIG. 11, the substrate 24 is formed with heaters and flow paths. So, the temperature of this member (base temperature) can be deemed almost equal to the temperature of ink in the print head. The base temperature varies, influenced by a surrounding temperature of the print head and by a temperature increase of the print head resulting from repetitive printing operations. The diagram shows that the ejection volume increases almost linearly with the base temperature. Four characteristic lines are shown here for four different drive voltages VH, with the k value kept constant. As explained in FIG. 14, the ejection volume decreases as the drive voltage VH increases.

In a single pulse drive control, by taking advantage of the characteristics explained with reference to FIG. 14 and FIG. 15, the ejection volume that changes according to variations in the print head temperature and heater rank can be kept within a predetermined range.

Figure 16:
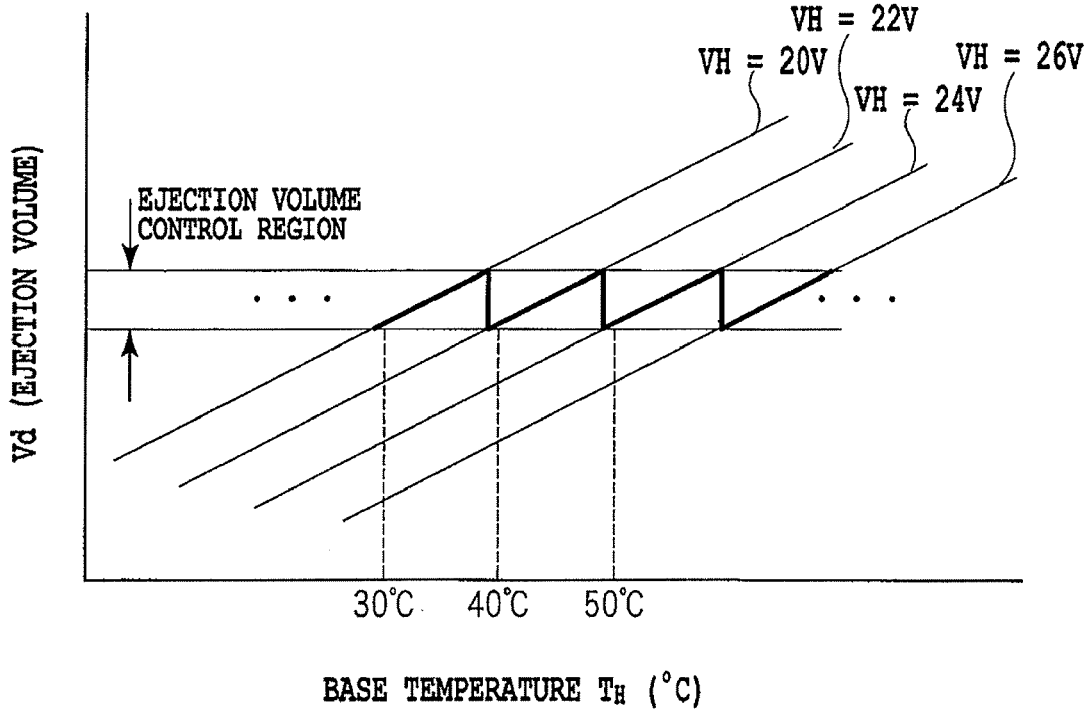
FIG. 16 is a graph showing a control method that keeps the ejection volume during printing within a predetermined range by switching the drive voltage according to the detected base temperature.

FIG. 16 shows a control method to keep the ejection volume during printing within a predetermined range by changing the drive voltage VH according to the detected base temperature. For example, when the base temperature is 30° C., to have the ejection volume fall within a target control range needs to set the drive voltage VH at 20 V. If the base temperature reaches 40° C. after continued printing, the ejection volume can be held within the control range by raising the drive voltage VH to 22 V. Further, if the base temperature detected increases to 50° C., the drive voltage VH needs to be raised to 24 V. The relation between the base temperature and the ejection volume in this control follows a locus indicated by a thick line in the diagram, showing that the ejection volume is kept within the control range at any base temperature. Since the k value is kept constant in any case, the pulse width P is set smaller as the drive voltage VH increases.

To keep the ejection volume constant in a wide temperature range, we have already described it is effective to set relatively low the drive voltage at the start temperature and that this, however, increases the time taken by each ejection, making it difficult to meet the requirement of high speed printing. It is noted, however, that the user does not always seek the high quality image and the high speed printing at the same time. The priority among the needs often changes according to the use. Taking this fact into consideration, the inventors of this invention have decided that the effective method to achieve a user satisfaction is to provide a plurality of print modes each having a priority given to a different need and appropriately differentiate the drive voltage at the start temperature among the different print modes.

So, the printing apparatus of this embodiment is constructed to execute at least two print modes—one that gives priority to the color stability of an output image (high quality mode) and one that gives priority to the printing speed (high speed mode). The user selects desired one of the print modes according to the use and then sets it by using a printer driver in the host computer. In this embodiment, the high quality mode gives priority to the image quality and performs an 8-pass printing. For improved color stability, the high quality mode sets the drive voltage at the start temperature relatively low to stabilize the ejection volume in as wide a temperature range as possible. The high speed mode on the other hand places greater importance on the print speed and thus performs a 4-pass printing with fewer print scans than the high quality mode. Since the high speed mode puts emphasis on an increased ejection frequency over the color stability, the drive voltage at the start temperature is set relatively high.

Figure 17:
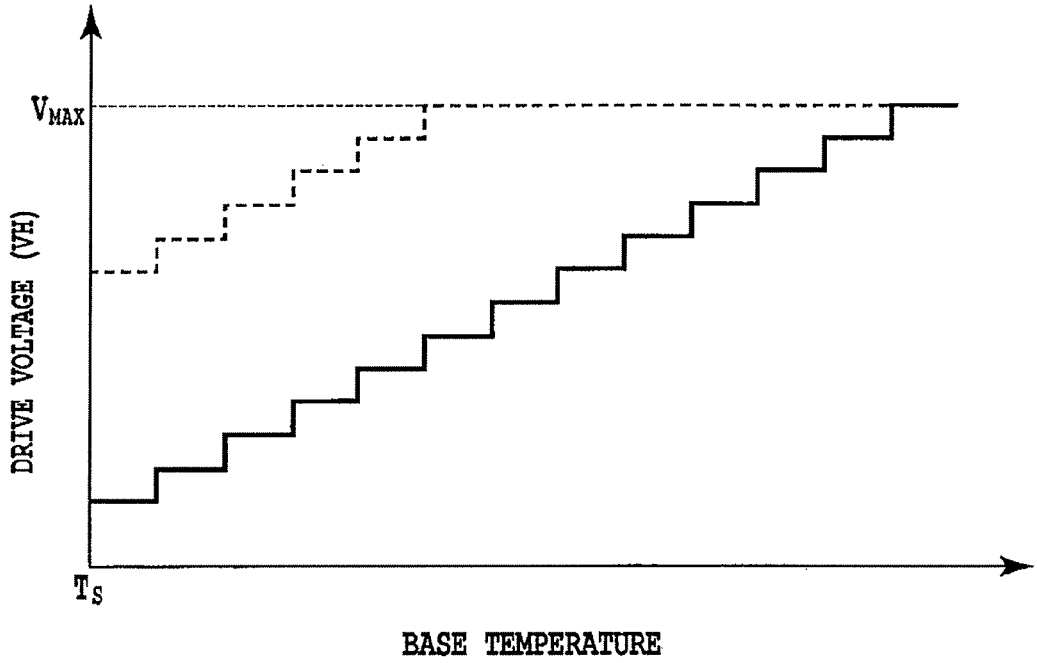
FIG. 17 is a diagram showing a relation between the drive voltage VH and the base temperature in a first embodiment of this invention by comparing a high quality mode and a high speed mode.

FIG. 17 compares the high quality mode and a high speed mode in terms of the relation between the base temperature and the drive voltage VH in this embodiment. In the figure, an abscissa represents the base temperature of the print head and an ordinate represents a drive pulse voltage applied to individual heaters. Vmax represents an upper limit of the drive voltage that can be provided by the head drive voltage modulation circuit E3001 in the printing apparatus of this embodiment. Further, a solid line represents a control condition of the drive voltage used for the high quality mode and a dashed line represents a control condition of the drive voltage used for the high speed mode.

In the high quality mode, the voltage applied at the start temperature Ts is set relatively low and is progressively increased stepwise as the base temperature increases. The reason that the drive voltage is increased stepwise with the base temperature is that the minimum width of the drive voltage and the minimum step of the base temperature are determined by limitations on the hardware or software of the printing apparatus. In the high quality mode the ejection volume can be kept within a predetermined range over a wide temperature range from the start temperature to a temperature where the drive voltage reaches Vmax.

In the high speed mode, on the other hand, the voltage applied at the start temperature Ts is set relatively high and, from this point, is progressively increased stepwise. Thus, the temperature at which the drive voltage reaches Vmax is lower than that of the high quality mode and, in a temperature range higher than this temperature, the same voltage value Vmax is used. That is, the temperature range in which the ejection volume can be controlled is narrower in the high speed mode than in the high quality mode. However, since the pulse width is set by keeping the k value constant in either mode, the drive pulse in the high speed mode is relatively shorter than in the high quality mode, reducing the time taken by one ejection. Whether in the high speed mode or high quality mode, the drive frequency of the print head in one mode is kept constant and its value is determined by the width of the longest drive pulse in the entire temperature range. That is, in the high speed mode in which the width of the longest drive pulse is shorter than that of the high quality mode, the drive frequency can be set high to make the carriage speed fast, realizing a high-speed image output.

A high speed mode and a high quality mode that have different voltages at the same base temperature of the print head, while keeping the k value constant, have different ejection volumes as explained with reference to FIG. 14. That is, the high speed mode with a higher drive voltage has a smaller ejection volume and a lower density of an output image. In the high speed mode, when the base temperature rises and the drive voltage reaches Vmax, the ejection volume tends to increase sharply, raising the density. Such a high speed mode is likely to be troubled with various image impairment problems.

However, what the high speed mode of this embodiment handles is mostly images of monochrome information, such as documents and web pages. Therefore, even if ejection volume at the start temperature is small, there is little likelihood that the insufficient density may affect the image quality. Further, if the images to be printed are mostly documents, the number of ejections in the print head will not become so large and there is little possibility of the base temperature rising to a region where the ejection volume cannot be controlled. That is, the high speed mode of this embodiment can output stable images at high speed by performing the ejection volume control in a relatively small ejection volume.

In this embodiment, the base temperature is acquired in each printing scan to set an appropriate voltage pulse. To appropriately change the drive pulse according to the print mode and the base temperature as described above requires the provision of a table storing drive pulses for each print mode and base temperature and of a construction that sets an appropriate drive pulse by referencing the table in each printing scan. For example, controller of the print apparatus may have the data table (memory) storing drive pulses (drive pulse information) for each print mode and base temperature.

As described above, in an ink jet printing apparatus that performs the single pulse drive control, this embodiment provides a plurality of print modes having different drive voltages at the start temperature, making it possible to appropriately deal with different user needs according to the use.

Second Embodiment

This embodiment, too, executes a high quality mode that gives priority to the color stability of an output image and a high speed mode that gives priority to the print speed, by using the ink jet print system and the ink jet print head explained with reference to FIG. 1 through FIG. 13 as in the preceding embodiment. The user selects a desired print mode from multiple modes according to the use and sets it in the printer driver of the host computer.

In this embodiment also, a single pulse drive control to keep the ejection volume within a specified range is performed. The drive voltage in the high speed mode at the start is set higher than in the high quality mode.

Figure 18:
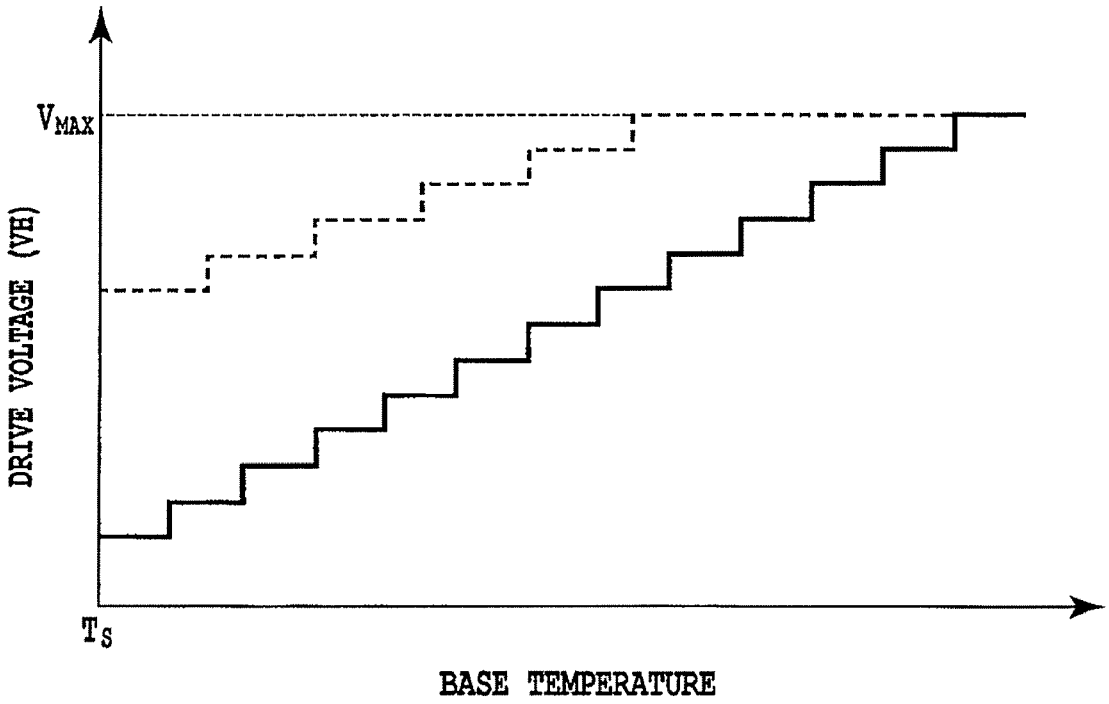
FIG. 18 is a diagram showing a relation between the drive voltage VH and the base temperature in a second embodiment of this invention by comparing a high quality mode and a high speed mode.

FIG. 18 compares the high quality mode and the high speed mode in terms of the relation between the base temperature and the drive voltage VH in this embodiment, in the same way as shown in FIG. 17. In this diagram too, the solid line represents a control condition of the drive voltage used for the high quality mode and the dashed line represents a control condition of the drive voltage used for the high speed mode.

In this embodiment, the drive condition for the high quality mode (solid line) is the same as that of the first embodiment. In the high speed mode, on the other hand, while the drive voltage at the start temperature is equal to that of the first embodiment, the drive voltage for the subsequent base temperature is increased at a rate more moderate than that of the first embodiment. More specifically, compared with the drive condition of the first embodiment, the second embodiment requires a greater temperature rise before the drive voltage can be raised one step. Referring to FIG. 18, the control condition of the drive voltage is decided so that as the base temperature is higher, difference in the drive voltage between of the high quality mode and of high speed mode is smaller. The controller of the print apparatus may have the data table (memory) storing drive pulses (drive pulse information) for each print mode and base temperature.

Adopting this drive condition in the high speed mode allows the ejection volume control to be performed in a wider temperature range than that of the first embodiment although the temperature variations are large. That is, this embodiment is more effectively applied than the first embodiment to those environments where the base temperature of the print head easily increases or where a number of pages are expected to be printed continuously.

In this embodiment too, the above drive control can be realized if a table storing drive pulses for each print mode and base temperature and a construction that sets the drive pulse by referring to the table are provided.

As described above, in an ink jet printing apparatus that performs a single pulse drive control, this embodiment prepares a plurality of print modes having different drive voltage at the start temperature and different gradients of drive voltage with respect to temperature change. This makes it possible to appropriately deal with different user needs according to the use.

Third Embodiment

This embodiment also can execute a high quality mode that gives priority to the color stability of an output image and a high speed mode that gives priority to the print speed, by using the ink jet print system and the ink jet print head shown in FIG. 1 to FIG. 13, as in the preceding embodiments. The user selects an appropriate print mode from among multiple print modes according to the use and then sets it in the printer driver of the host computer.

Figure 19:
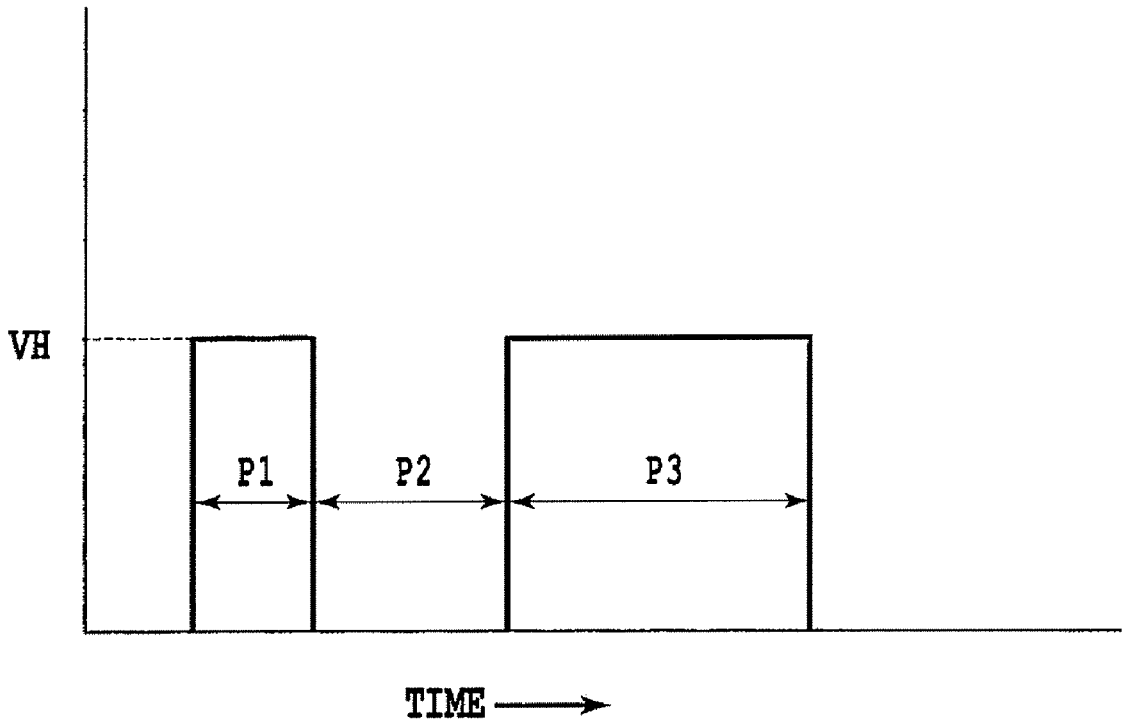
FIG. 19 is a timing chart showing a double pulse drive control.

In this embodiment, however, a double pulse drive is used to execute a control to keep the ejection volume within a specified range. As already explained, the double pulse drive control applies two pulses of FIG. 19 to a heater for one ejection. Although the actual ejection is done by a main heat pulse having a pulse width P3, the ejection volume can be changed by adjusting a pulse width P1 of a preheat pulse and an interval P2.

Figure 20:
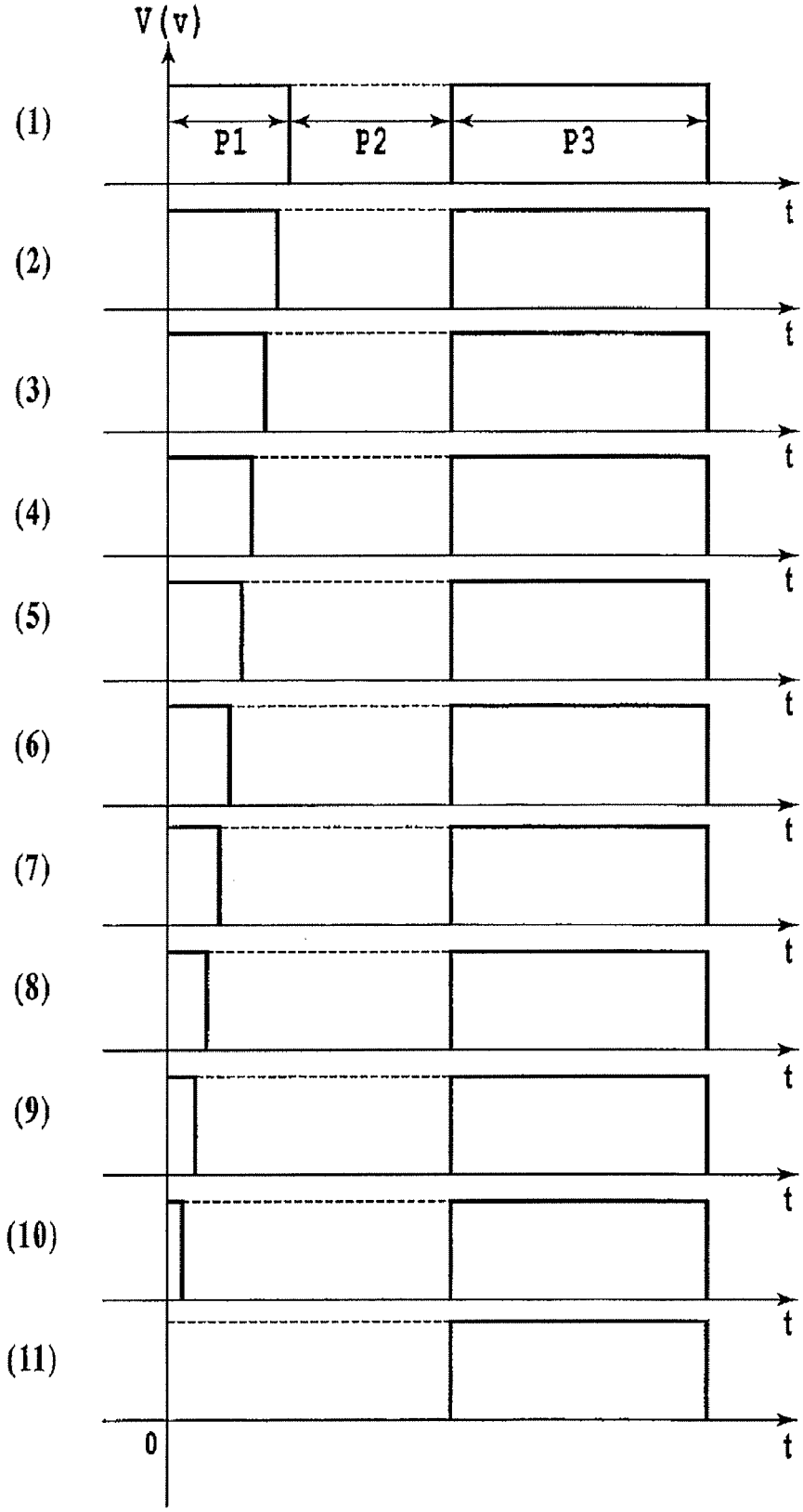
FIG. 20 illustrates pulses when a preheat pulse width and its interval are changed stepwise, with the main heat pulse kept constant.

FIG. 20 shows waveforms of a pulse signal when the preheat pulse width P1 and the interval P2 are changed stepwise, as shown at (1) to (11), with the main heat pulse width P3 fixed. (1) represents a case where the preheat pulse width P1 is largest and (11) represents a case where the preheat pulse width P1 is zero.

Figure 21:
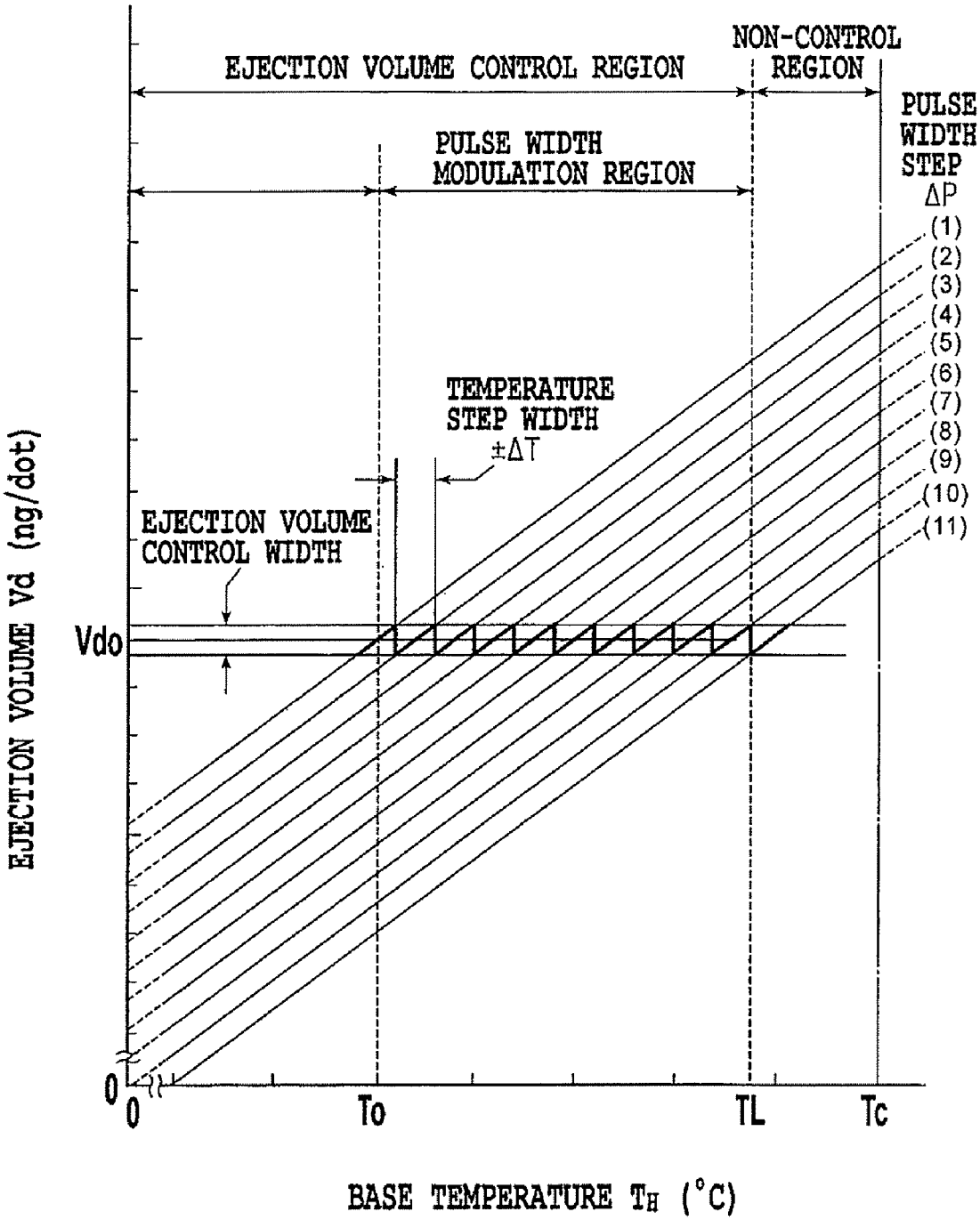
FIG. 21 is a graph showing a control method that keeps the ejection volume during printing within a predetermined range by changing the preheat pulse width according to a relation between the base temperature and the ejection volume and the detected base temperature.

FIG. 21 explains a relation between the base temperature and the ejection volume and a control method that keeps the ejection volume during printing within a specified range by changing the preheat pulse width according to the detected base temperature. In FIG. 21, the ejection volume increases almost linearly with the base temperature. This diagram also shows a plurality of results for each of the pulse waveforms shown at (1)-(11) of FIG. 20 and that the ejection volume increases with the preheat pulse width P1. That is, in the double pulse drive control, changing the pulses according to the detected base temperature in a way that describes a locus of thick line in the figure can keep the ejection volume within the control range at any base temperature.

In performing the double pulse drive control, it is preferable to set the heater drive voltage relatively low. This is because a lower drive voltage allows the heat flux to be set lower, making more detailed control on the ejection volume by the preheat pulse width possible. Generally, it can also be said that the double pulse drive control, which adjusts the preheat pulse application time with the drive voltage kept constant, has higher control reliability. However, as the size reduction of ink droplets progresses rapidly in recent years, it is increasingly difficult to stably maintain the small ejection volume with only the double pulse drive control. For example, consider a case where the print head temperature continues to rise as a result of continuous printing operation. To reduce the ejection volume, the width of the preheat pulse is narrowed. However, even when the pulse width is zero, the ejection volume may still remain too large.

Therefore in this embodiment, when the base temperature is relatively low, the double pulse drive control is performed using a low drive voltage. From when the base temperature exceeds a level where the preheat pulse width P1 becomes zero, a single pulse drive control is activated. This control procedure can be expected to ensure ejection of small droplets of a specified volume if the temperature of the print head varies in a relatively wide range, by using the double pulse drive control and the single pulse drive control properly.

Figure 22:
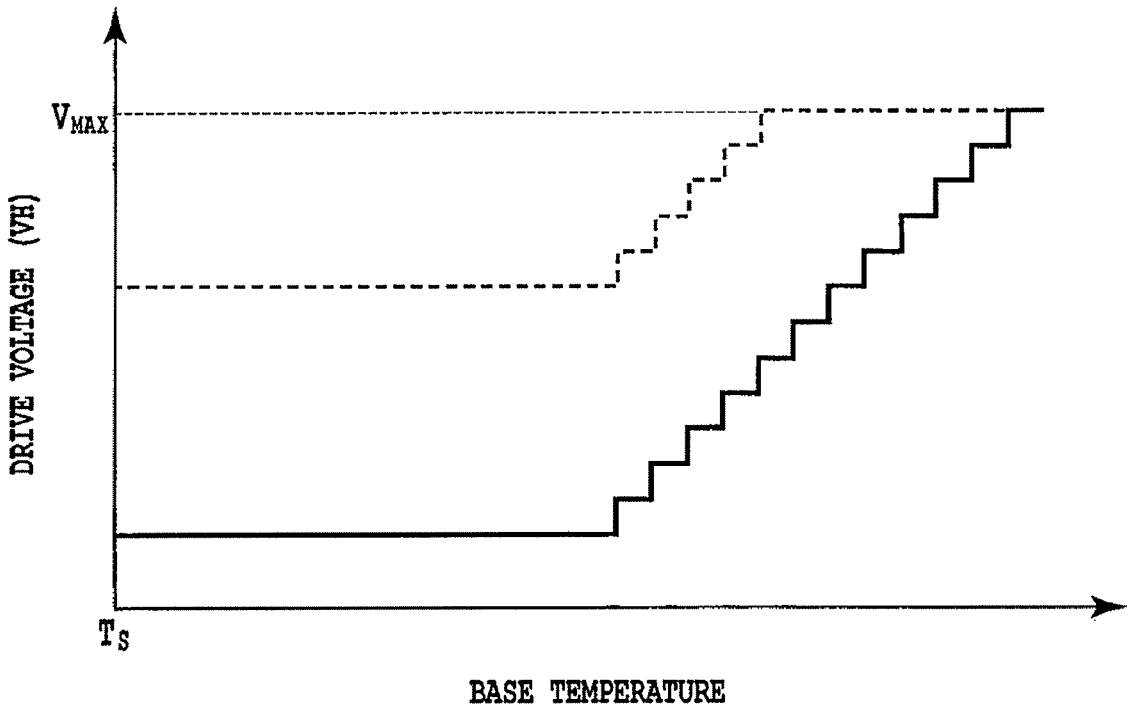
FIG. 22 is a diagram showing a relation between the drive voltage VH and the base temperature in a third embodiment of this invention by comparing a high quality mode and a high speed mode.

FIG. 22 compares the high quality mode and the high speed mode in terms of the relation between the base temperature and the drive voltage VH in this embodiment. Here, too, the solid line represents a control condition of the drive voltage used in the high quality mode and the dashed line represents a control condition of the drive voltage used in the high speed mode.

This embodiment performs the double pulse drive control either in the high speed mode or the high quality mode in a temperature range from the start temperature Ts to a level where the preheat pulse width becomes zero. In a temperature range exceeding the level where the preheat pulse width becomes zero, the single pulse drive control is brought into operation.

Figure 23:
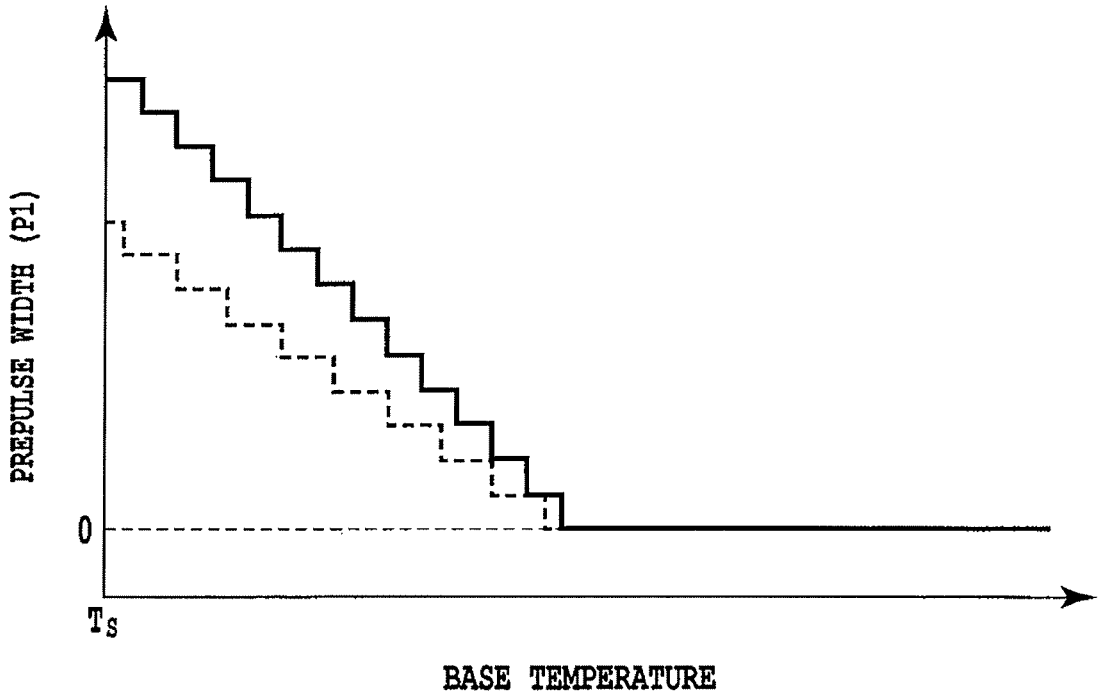
FIG. 23 is a diagram showing a relation between the preheat pulse width and the base temperature in a third embodiment of this invention by comparing a high quality mode and a high speed mode.

FIG. 23 compares the high quality mode and the high speed mode in terms of the relation between the base temperature and the preheat pulse width P1 in this embodiment. Here, too, the solid line represents a control condition of the drive voltage used in the high quality mode and the dashed line represents a control condition of the drive voltage used in the high speed mode.

In the high quality mode of this embodiment, the drive voltage of the double pulse drive control is set lower than that of the high speed mode and therefore the preheat pulse width P1 at the start temperature is set that much longer. In a temperature range from the start temperature Ts to a level where the preheat pulse width becomes almost zero, the preheat pulse width P1 progressively decreases as the base temperature rises. When the preheat pulse width P1 becomes zero, the ejection volume control switches to a single pulse drive control and, from then on, the drive voltage VH is increased progressively as the base temperature rises. When compared with the two preceding embodiments, this embodiment can perform the ejection volume control in a wide temperature range on the high-temperature side because the start temperature for the single pulse drive control of this embodiment is increased from the start temperature Ts to a temperature where the preheat pulse width becomes zero.

In the high speed mode, on the other hand, the voltage applied at the start temperature is higher than that of the high quality mode and the preheat pulse width P1 is set shorter. In a temperature range from the start temperature Ts to a temperature where the preheat pulse width becomes zero, the preheat pulse width P1 is progressively decreased as the base temperature increases, as in the high quality mode. It is noted, however, that because the drive voltage VH is higher, the rate at which the preheat pulse width P1 is reduced is greater than in the high quality mode. When the preheat pulse width P1 in the high speed mode is almost zero, the ejection volume control switches to the single pulse drive control. Then, as in the preceding embodiments, the drive voltage VH is increased progressively as the base temperature rises. Since the drive voltage at the start temperature is higher in the high speed mode, it reaches Vmax at a lower temperature than in the high quality mode. That is, in a temperature range higher than that temperature, the same voltage value Vmax is used rendering the ejection volume control impossible.

It is noted, however, that, when compared with the preceding embodiments, this embodiment has the start temperature for the single pulse drive control shifted upward from the start temperature Ts, making the ejection volume controllable range on the high-temperature side that much wider.

Since this embodiment also sets the pulse width by keeping the k value constant, the drive pulse for the high speed mode is relatively shorter than that of the high quality mode, taking a shorter time for one ejection. Thus in the high speed mode, it is possible to set the drive frequency and therefore the carriage speed high than that of the high quality mode, realizing a high speed image output.

Adding to above embodiments, as explained referring to FIGS. 17 and 18, the maximum voltage used when the high speed mode selected is equivalent to that used when the high quality mode selected. The maximum voltage (the upper limit of voltage) of the drive pulse used when the high speed mode is selected is determined based on that used when the high quality mode is selected.

The relationship between the maximum voltage of the high speed mode and the maximum voltage of the high quality mode is not limited to above embodiments. For example, the upper limit of the voltage of drive pulse used when the high speed mode is selected may be higher than that used when the high quality mode is selected, by a constant amount.

As described above, in an ink jet printing apparatus that performs the ink ejection volume control by using a combination of the double pulse drive control and the single pulse drive control, the present embodiment provides a plurality of print modes having different drive voltages at the start temperature. This arrangement allows for the ejection volume control in an even wider temperature range and also makes it possible to deal properly with different user needs according to the use.

In this embodiment, we have explained two example print modes that switch between the double pulse drive control and the single pulse drive control at almost the same temperature. This embodiment is not limited to these print modes. Depending on the setting of the start drive voltage VH, the base temperature at which the double pulse drive control cannot be performed is not always constant. The advantage of this invention remains unchanged if the base temperature at which the double pulse drive control is switched to the single pulse drive control varies among a plurality of more print modes provided.

A plurality of print modes provided may include a mode that performs the double pulse drive control in the entire temperature range, a mode that performs the single pulse drive control in the entire temperature range, and a mode that switches between the double pulse drive control and the single pulse drive control at a predetermined temperature. They may have different drive voltage at the start temperature.

The ejection volume of the print head is known to depend not only on the base temperature and the drive voltage VH but also on resistances (electric characteristics) of heaters arranged on the substrate and ink compositions. That is, even if the base temperatures and the pulse waveforms are the same, different heater resistances and different ink characteristics (ease with which a bubble is formed, and heat conductivity) can result in variations in ejection volume and even ejection/non-ejection. In the following explanations, a parameter that affects the ejection volume of each nozzle column, i.e., which may cause ink ejection/non-ejection or variations in ejection volume even when equal base temperatures or equal drive pulse waveforms are used, is called a heater rank (rank information). This heater rank is determined by various elements making up the print head. Particularly when a film thickness of the heaters is reduced to make the head compact, variations in the film thickness appear as heater rank variations. Further, even if the same resistances are used, the bubble formability and heat conductivity may vary depending on the kind of ink, resulting in different heater ranks. Adding explanation about the heater rank (rank information), heater rank is an information of amount of heat conveyed from the heater to the ink in a unit time. A heater with a small heater rank, when compared with a heater with a large heater rank, can convey a greater amount of heat to the ink in a unit time. That is, a heater with a smaller heater rank has a greater heat flux.

In a print head having a plurality of nozzle columns to eject different inks, as shown in FIG. 11, the heater rank may differ among different ink colors. At the same time, to assure a color stability it is required that the ejection volumes of all nozzle columns be kept within a specified range for any base temperature. In such a case, a table needs to be prepared which allows an appropriate drive pulse to be set according to conditions such as print mode, base temperature and heater rank. Using this table, appropriate drive voltage VH and pulse width P can be set for all heater ranks. Therefore, as in the preceding embodiments, this embodiment allows for the ejection volume control in a wide temperature range, making it possible to properly deal with various user needs according to the use.

In the above embodiments, we have explained the method of stabilizing the ejection volume by modulating the drive pulse waveform according to the base temperature that changes depending on an ambient temperature or when the printing is performed continuously. However, the base temperature itself can be stabilized by providing a construction that positively controls the base temperature of the print head. For example, in addition to the ink ejection heaters, a print head warming heater may be provided which is turned on or off to adjust the base temperature. The ink temperature may also be kept within a specified range by a control that applies to the ejection heaters a short pulse, not contributing to the ink ejection. By combining these temperature controls with the above described embodiments, a stable ejection volume control can be performed in an even wider temperature range.

In the explanation of the above embodiments, information transferred from a temperature sensor not shown, installed in the substrate 24, to the main printed circuit board is called the base temperature. The above construction, however, does not limit the present invention in any way. The temperature information used in the pulse setting does not need to be a temperature of the substrate 24. Instead, a directly measured ink temperature may be used. Further, the ink temperature may be estimated from a temperature of portions other than the substrate of the print head.

Further, in this invention, the method of selecting and setting one of a plurality of print modes may be performed without using a printer driver of the host computer as employed in the above embodiments. For example, a means may be arranged on a front panel of the printing apparatus to allow a desired print mode to be set. In another example a printing apparatus may be provided with a means which detects the kind of print medium and, according to the kind of print medium detected, automatically sets an appropriate print mode. Further, an appropriate print mode may be selected by a setting means on other devices, such as a digital camera, that can be connected to the printing apparatus.

Furthermore, the explanation of the above embodiments concerns a serial type ink jet printing apparatus which forms an image by intermittently alternating the main scan of the print head and a subscan of the print medium. This invention is not limited to this type of printing apparatus. This invention is also applicable to an ink jet printing apparatus having a full line type print head whose nozzle column is equal in length to the print width of a print medium. The present invention can be advantageously applied to whatever type of ink jet printing apparatus as long as it has heaters arrayed in individual printing elements of the print head and applied a voltage pulse for ink ejection.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-108069, filed Apr. 10, 2006, which is hereby incorporated by reference herein in its entirety.

What is claimed is:

1. An ink jet printing apparatus for forming an image on a print medium by using a print head, wherein the print head includes an array of a plurality of print elements each adapted to eject ink by applying a pulse to a heater, the ink jet printing apparatus comprising:

selection means for selecting one of a plurality of print modes;

acquire means for acquiring an ink temperature in the print head;

setting means for setting the pulse to be applied to the heater according to information about the print mode selected by the selection means and about the ink temperature acquired by the acquire means; and driving means for driving one of the print elements by applying the set pulse to the heater;

wherein the plurality of print modes includes at least a high quality mode that gives priority to an image quality and a high speed mode that gives priority to a printing speed, and wherein, in a predetermined temperature range, the pulse set by the setting means when the high speed mode is selected has a higher voltage value and a shorter pulse width than those of a pulse set when the high quality mode is selected.

2. An ink jet printing apparatus according to claim 1, wherein the setting means sets a pulse that keeps an ink volume ejected in the selected print mode within a specified range, regardless of the acquired ink temperature.

3. An ink jet printing apparatus according to claim 1, wherein a drive frequency of the driving means is higher in the high speed mode than in the high quality mode.

4. An ink jet printing apparatus according to claim 1, wherein a waveform of the pulse set by the setting means comprises two pulses for one ejection.

5. An ink jet printing apparatus according to claim 1, wherein a waveform of the pulse set by the setting means comprises one pulse for one ejection.

6. An ink jet printing apparatus according to claim 1, further comprising a voltage modulation circuit that can change a voltage value that the drive means applies according to the pulse set by the setting means.

7. An ink jet printing apparatus according to claim 1, wherein the setting means sets the pulse by referring to a pulse table that defines a voltage value and a pulse width of the pulse for each print mode and for each ink temperature.

8. An ink jet printing apparatus according to claim 1, further comprising means for acquiring a rank information representing an amount of heat conveyed from the heater to the ink in unit time, wherein the setting means sets the pulse by referring to a pulse table that defines a voltage value and a pulse width of the pulse from the print mode, the ink temperature and the rank information.

9. An ink jet printing apparatus according to claim 1, wherein an image is formed on the print medium by intermittently alternating a main scan that causes the print head to eject ink by the drive means as the print head moves relative to the print medium and a subscan that transports the print medium in a direction crossing the direction of the main scan.

10. An ink jet printing apparatus according to claim 9, further comprising multipass printing means for forming an image by performing a plurality of main scans over an area that can be printed by one main scan, wherein the number of main scans when at least one print mode is selected differs from the number of main scans when other print modes are selected.

11. An ink jet printing apparatus according to claim 1, wherein an ink volume ejected in the high quality mode is greater than that ejected in the high speed mode.

12. An ink jet printing apparatus according to claim 1, wherein a region of the ink temperature corresponding to one kind of pulse set by the setting means in the high quality mode is wider than a region of the ink temperature corresponding to one kind of pulse set in the high speed mode.

13. An ink jet printing apparatus according to claim 1, wherein the maximum voltage of the pulse set by the setting means when the high speed mode is selected based on the maximum voltage of the pulse set when the high quality mode is selected.

14. An ink jet printing method for forming an image on a print medium by using a print head, wherein the print head includes an array of a plurality of print elements each adapted to eject ink by applying a pulse to a heater, the ink jet printing method comprising the steps of:

selecting one of a plurality of print modes;

acquiring an ink temperature in the print head;

setting the pulse to be applied to the heater according to information about the print mode selected by the selection step and about the ink temperature; and driving one of the print elements by applying the set pulse to the heater, wherein the plurality of print modes includes at least a high quality mode that gives priority to an image quality and a high speed mode that gives priority to a printing speed, and wherein, in a predetermined temperature range, the pulse set in the setting step when the high speed mode is selected has a higher voltage value and a shorter pulse width than those of a pulse set when the high quality mode is selected.

* * * * *